US010814175B2

(12) United States Patent
Madson et al.

(10) Patent No.: US 10,814,175 B2
(45) Date of Patent: Oct. 27, 2020

(54) DIMPLE PATTERNS FOR GOLF BALLS

(71) Applicant: Acushnet Company, Fairhaven, MA (US)

(72) Inventors: Michael R. Madson, Easton, MA (US); Nicholas M. Nardacci, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/785,624

(22) Filed: Feb. 9, 2020

(65) Prior Publication Data

US 2020/0230466 A1 Jul. 23, 2020

Related U.S. Application Data

(63) Continuation-in-part of application No. 16/417,559, filed on May 20, 2019, which is a continuation-in-part of application No. 16/132,924, filed on Sep. 17, 2018, now Pat. No. 10,315,076, which is a continuation-in-part of application No. 15/848,047, filed on Dec. 20, 2017, now Pat. No. 10,076,683, which is a continuation-in-part of application No. 15/387,766, filed on Dec. 22, 2016, now Pat. No. 9,873,021, which is a continuation-in-part of application No. 15/242,217, filed on Aug. 19, 2016, now Pat. No. 9,925,418, which is a continuation-in-part of application No. 13/973,237, filed on Aug. 22, 2013, now Pat. No. 9,468,810, (Continued)

(51) Int. Cl.
*A63B 37/12* (2006.01)
*A63B 37/00* (2006.01)

(52) U.S. Cl.
CPC ..... *A63B 37/0006* (2013.01); *A63B 37/002* (2013.01); *A63B 37/0004* (2013.01); *A63B 37/0007* (2013.01); *A63B 37/0018* (2013.01)

(58) Field of Classification Search
CPC ..... A63B 37/0006
USPC ..... 473/380, 382
See application file for complete search history.

(56) References Cited

U.S. PATENT DOCUMENTS 4,998,733 A 3/1991 Lee
5,046,742 A 9/1991 Mackey
(Continued)

FOREIGN PATENT DOCUMENTS

JP 4102986 B 6/2008

OTHER PUBLICATIONS

English Translation of Japanese Patent JP4102986.

*Primary Examiner* — Raeann Gorden
(74) *Attorney, Agent, or Firm* — Mandi B. Milbank

(57) ABSTRACT

The present invention provides a method for arranging dimples on a golf ball surface in which the dimples are arranged in a pattern derived from at least one irregular domain generated from a regular or non-regular polyhedron. The method includes choosing control points of a polyhedron, generating an irregular domain based on those control points, packing the irregular domain with dimples, and tessellating the irregular domain to cover the surface of the golf ball. The control points include the center of a polyhedral face, a vertex of the polyhedron, a midpoint or other point on an edge of the polyhedron and others. The method ensures that the symmetry of the underlying polyhedron is preserved while minimizing or eliminating great circles due to parting lines.

18 Claims, 26 Drawing Sheets

Related U.S. Application Data which is a continuation of application No. 12/894,827, filed on Sep. 30, 2010, now abandoned, which is a continuation-in-part of application No. 12/262,464, filed on Oct. 31, 2008, now Pat. No. 8,029,388.

(56) References Cited

U.S. PATENT DOCUMENTS

| | | | | |
|---|---|---|---|---|
| 5,249,804 | A | 10/1993 | Sanchez | |
| 5,562,552 | A | 10/1996 | Thurman | |
| 5,890,974 | A | 4/1999 | Stiefel et al. | |
| 6,123,534 | A | 9/2000 | Kasashima et al. | |
| 6,241,627 | B1 | 6/2001 | Kasashima et al. | |
| 6,682,442 | B2 | 1/2004 | Winfield | |
| 6,685,455 | B2 | 2/2004 | Ogg | |
| 7,179,178 | B2 | 2/2007 | Veilleux | |
| 7,422,529 | B2 | 9/2008 | Aoymama et al. | |
| 8,029,388 | B2 | 10/2011 | Nardacci et al. | |
| 2010/0113187 | A1 | 5/2010 | Nardacci et al. | |
| 2011/0165968 | A1 | 7/2011 | Madson et al. | |
| 2012/0088607 | A1 | 4/2012 | Madson et al. | |
| 2013/0065709 | A1 | 3/2013 | Madson et al. | |
| 2013/0072325 | A1 | 3/2013 | Madson et al. | |
| 2016/0107037 | A1 * | 4/2016 | Parsons ..... | A63B 37/0009 473/384 |
| 2016/0354640 | A1 | 12/2016 | Madson et al. | |
| 2016/0354641 | A1 | 12/2016 | Madson et al. | |

* cited by examiner

DIMPLE PATTERNS FOR GOLF BALLS

CROSS-REFERENCE TO RELATED APPLICATIONS

This application is a continuation-in-part of U.S. patent application Ser. No. 16/417,559, filed May 20, 2019, which is a continuation-in-part of U.S. patent application Ser. No. 16/132,924, filed Sep. 17, 2018, now U.S. Pat. No. 10,315,076, which is a continuation-in-part of U.S. patent application Ser. No. 15/848,047, filed Dec. 20, 2017, now U.S. Pat. No. 10,076,683, which is a continuation-in-part of U.S. patent application Ser. No. 15/387,766, filed Dec. 22, 2016, now U.S. Pat. No. 9,873,021, which is a continuation-in-part of U.S. patent application Ser. No. 15/242,217, filed Aug. 19, 2016, now U.S. Pat. No. 9,925,418, which is a continuation-in-part of U.S. patent application Ser. No. 13/973,237, filed Aug. 22, 2013, now U.S. Pat. No. 9,468,810, which is a continuation of U.S. patent application Ser. No. 12/894,827, filed Sep. 30, 2010, now abandoned, which is a continuation-in-part of U.S. patent application Ser. No. 12/262,464, filed Oct. 31, 2008, now U.S. Pat. No. 8,029,388, the entire disclosures of which are hereby incorporated herein by reference.

FIELD OF THE INVENTION

This invention relates to golf balls, particularly to golf balls possessing uniquely packed dimple patterns. More particularly, the invention relates to methods of arranging dimples on a golf ball by generating irregular domains based on polyhedrons, packing the irregular domains with dimples, and tessellating the domains onto the surface of the golf ball.

BACKGROUND OF THE INVENTION

Historically, dimple patterns for golf balls have had a variety of geometric shapes, patterns, and configurations. Primarily, patterns are laid out in order to provide desired performance characteristics based on the particular ball construction, material attributes, and player characteristics influencing the ball's initial launch angle and spin conditions. Therefore, pattern development is a secondary design step that is used to achieve the appropriate aerodynamic behavior, thereby tailoring ball flight characteristics and performance.

Aerodynamic forces generated by a ball in flight are a result of its velocity and spin. These forces can be represented by a lift force and a drag force. Lift force is perpendicular to the direction of flight and is a result of air velocity differences above and below the rotating ball. This phenomenon is attributed to Magnus, who described it in 1853 after studying the aerodynamic forces on spinning spheres and cylinders, and is described by Bernoulli's Equation, a simplification of the first law of thermodynamics. Bernoulli's equation relates pressure and velocity where pressure is inversely proportional to the square of velocity. The velocity differential, due to faster moving air on top and slower moving air on the bottom, results in lower air pressure on top and an upward directed force on the ball.

Drag is opposite in sense to the direction of flight and orthogonal to lift. The drag force on a ball is attributed to parasitic drag forces, which consist of pressure drag and viscous or skin friction drag. A sphere is a bluff body, which is an inefficient aerodynamic shape. As a result, the accelerating flow field around the ball causes a large pressure differential with high-pressure forward and low-pressure behind the ball. The low pressure area behind the ball is also known as the wake. In order to minimize pressure drag, dimples provide a means to energize the flow field and delay the separation of flow, or reduce the wake region behind the ball. Skin friction is a viscous effect residing close to the surface of the ball within the boundary layer.

The industry has seen many efforts to maximize the aerodynamic efficiency of golf balls, through dimple disturbance and other methods, though they are closely controlled by golf's national governing body, the United States Golf Association (U.S.G.A.). One U.S.G.A. requirement is that golf balls have aerodynamic symmetry. Aerodynamic symmetry allows the ball to fly with a very small amount of variation no matter how the golf ball is placed on the tee or ground. Preferably, dimples cover the maximum surface area of the golf ball without detrimentally affecting the aerodynamic symmetry of the golf ball.

In attempts to improve aerodynamic symmetry, many dimple patterns are based on geometric shapes. These may include circles, hexagons, triangles, and the like. Other dimple patterns are based in general on the five Platonic Solids including icosahedron, dodecahedron, octahedron, cube, or tetrahedron. Yet other dimple patterns are based on the thirteen Archimedian Solids, such as the small icosidodecahedron, rhomicosidodecahedron, small rhombicuboctahedron, snub cube, snub dodecahedron, or truncated icosahedron.

Furthermore, other dimple patterns are based on hexagonal dipyramids. Because the number of symmetric solid plane systems is limited, it is difficult to devise new symmetric patterns. Moreover, dimple patterns based some of these geometric shapes result in less than optimal surface coverage and other disadvantageous dimple arrangements. Therefore, dimple properties such as number, shape, size, volume, and arrangement are often manipulated in an attempt to generate a golf ball that has improved aerodynamic properties.

U.S. Pat. No. 5,562,552 to Thurman discloses a golf ball with an icosahedral dimple pattern, wherein each triangular face of the icosahedron is split by a three straight lines which each bisect a corner of the face to form 3 triangular faces for each icosahedral face, wherein the dimples are arranged consistently on the icosahedral faces.

U.S. Pat. No. 5,046,742 to Mackey discloses a golf ball with dimples packed into a 32-sided polyhedron composed of hexagons and pentagons, wherein the dimple packing is the same in each hexagon and in each pentagon.

U.S. Pat. No. 4,998,733 to Lee discloses a golf ball formed of ten "spherical" hexagons each split into six equilateral triangles, wherein each triangle is split by a bisecting line extending between a vertex of the triangle and the midpoint of the side opposite the vertex, and the bisecting lines are oriented to achieve improved symmetry.

U.S. Pat. No. 6,682,442 to Winfield discloses the use of polygons as packing elements for dimples to introduce predictable variance into the dimple pattern. The polygons extend from the poles of the ball to a parting line. Any space not filled with dimples from the polygons is filled with other dimples.

SUMMARY OF THE INVENTION

In one embodiment, the present invention is directed to a golf ball having an outer surface comprising a parting line and a plurality of dimples. The dimples are arranged in multiple copies of one or more irregular domain(s) covering the outer surface in a uniform pattern. The irregular domain(s) are defined by non-straight segments, and one of the non-straight segments of each of the multiple copies of the irregular domain(s) forms a portion of the parting line.

In another embodiment, the present invention is directed to a method for arranging a plurality of dimples on a golf ball surface. The method comprises generating a first and a second irregular domain based on a tetrahedron using a midpoint to midpoint method, mapping the first and second irregular domains onto a sphere, packing the first and second irregular domains with dimples, and tessellating the first and second domains to cover the sphere in a uniform pattern. The midpoint to midpoint method comprises providing a single face of the tetrahedron, the face comprising a first edge connected to a second edge at a vertex; connecting the midpoint of the first edge with the midpoint of the second edge with a non-straight segment; rotating copies of the segment about the center of the face such that the segment and the copies fully surround the center and form the first irregular domain bounded by the segment and the copies; and rotating subsequent copies of the segment about the vertex such that the segment and the subsequent copies fully surround the vertex and form the second irregular domain bounded by the segment and the subsequent copies.

In another embodiment, the present invention is directed to a golf ball having an outer surface comprising a plurality of dimples, wherein the dimples are arranged by a method comprising generating a first and a second irregular domain based on a tetrahedron using a midpoint to midpoint method, mapping the first and second irregular domains onto a sphere, packing the first and second irregular domains with dimples, and tessellating the first and second domains to cover the sphere in a uniform pattern.

In another embodiment, the present invention is directed to a golf ball having an outer surface comprising a plurality of dimples disposed thereon, wherein the dimples are arranged in multiple copies of a first domain and a second domain, the first domain and the second domain being tessellated to cover the outer surface of the golf ball in a uniform pattern having no great circles and consisting of four first domains and four second domains. The dimple pattern within the first domain is different from the dimple pattern within the second domain. The plurality of dimples comprises dimples having at least two different diameters, including a maximum dimple diameter and a minimum dimple diameter. The first domain and the second domain each consist of perimeter dimples and interior dimples. In a particular aspect of this embodiment, the perimeter dimples of the first domain consist of dimples having no more than two different diameters, the perimeter dimples of the second domain consist of dimples having at least two different diameters, and the diameter of at least one perimeter dimple is the maximum dimple diameter. In another particular aspect of this embodiment, the interior dimples of the first domain consist of dimples having at least three different diameters, the interior dimples of the second domain consist of dimples having no more than two different diameters, the diameter of at least one dimple in the first domain is the minimum dimple diameter, and the diameter of at least one dimple in the second domain is the minimum dimple diameter. In another particular aspect of this embodiment, none of the perimeter dimples of the first domain have a diameter that is the maximum or the minimum dimple diameter, the diameter of at least one of the perimeter dimples of the second domain is the maximum dimple diameter, and the diameter of at least one of the perimeter dimples of the second domain is the minimum dimple diameter.

In another embodiment, the present invention is directed to a golf ball having an outer surface comprising a plurality of dimples disposed thereon, wherein the dimples are arranged in multiple copies of a first domain and a second domain, the first domain and the second domain being tessellated to cover the outer surface of the golf ball in a uniform pattern having no great circles and consisting of four first domains and four second domains. The dimple pattern within the first domain is different from the dimple pattern within the second domain. The first domain is defined by three irregular segments and has three-way rotational symmetry about the central point of the first domain. The second domain is defined by three irregular segments and has three-way rotational symmetry about the central point of the second domain. The first domain consists of perimeter dimples and interior dimples, the perimeter dimples of the first domain being positioned adjacent to the three irregular segments defining the first domain. The second domain consists of perimeter dimples and interior dimples, the perimeter dimples of the second domain being positioned adjacent to the three irregular segments defining the second domain. In a particular aspect of this embodiment, all of the perimeter dimples of the first domain satisfy a diameter relationship such that $$\text{if } x_{dimple\ 1} > x_{dimple\ 2}$$

$$\text{then } d_{dimple\ 1} < d_{dimple\ 2},$$

where dimple 1 and dimple 2 are any two perimeter dimples of the first domain positioned adjacent to a common irregular segment, d is the dimple diameter, and x is the distance from the center of the dimple to the midpoint of a reference line connecting the endpoints of the common irregular segment. In another particular aspect of this embodiment, all of the perimeter dimples of the first domain satisfy a diameter relationship such that $$\text{if } x_{dimple\ 1} > x_{dimple\ 2}$$

$$\text{then } d_{dimple\ 1} > d_{dimple\ 2},$$

where dimple 1 and dimple 2 are any two perimeter dimples of the first domain positioned adjacent to a common irregular segment, d is the dimple diameter, and x is the distance from the center of the dimple to the midpoint of a reference line connecting the endpoints of the common irregular segment. In another particular aspect of this embodiment, all of the perimeter dimples of the first domain satisfy a diameter relationship such that $$\text{if } x_{dimple\ 1} > x_{dimple\ 2}$$

$$\text{then } d_{dimple\ 1} < d_{dimple\ 2},$$

where dimple 1 and dimple 2 are any two perimeter dimples of the first domain positioned adjacent to a common irregular segment, d is the dimple diameter, and x is the distance from the center of the dimple to the midpoint of a reference line connecting the endpoints of the common irregular segment of dimple 1 and dimple 2; and all of the perimeter dimples of the second domain satisfy a diameter relationship such that $$\text{if } x_{dimple\ 3} > x_{dimple\ 4}$$

$$\text{then } d_{dimple\ 3} > d_{dimple\ 4},$$

where dimple 3 and dimple 4 are any two perimeter dimples of the second domain positioned adjacent to a common irregular segment, d is the dimple diameter, and x is the distance from the center of the dimple to the midpoint of a reference line connecting the endpoints of the common irregular segment of dimple 3 and dimple 4.

In another embodiment, the present invention is directed to a golf ball having an outer surface comprising a plurality of dimples disposed thereon, wherein the dimples are arranged in multiple copies of a first domain and a second domain, the first domain and the second domain being tessellated to cover the outer surface of the golf ball in a uniform pattern having no great circles and consisting of four first domains and four second domains. The dimple pattern within the first domain is different from the dimple pattern within the second domain. The first domain is defined by three irregular segments and has three-way rotational symmetry about the central point of the first domain. The second domain is defined by three irregular segments and has three-way rotational symmetry about the central point of the second domain. The first domain consists of perimeter dimples and interior dimples. The perimeter dimples of the first domain are those dimples located within the first domain that are positioned adjacent to the three irregular segments defining the first domain. The interior dimples of the first domain are those dimples located within the first domain that are not positioned adjacent to the three irregular segments defining the first domain. The second domain consists of perimeter dimples and interior dimples. The perimeter dimples of the second domain are those dimples located within the second domain that are positioned adjacent to the three irregular segments defining the second domain. The interior dimples of the second domain are those dimples located within the second domain that are not positioned adjacent to the three irregular segments defining the second domain. In a particular aspect of this embodiment, none of the perimeter dimples of the first domain has the same dimple diameter as a perimeter dimple of the second domain. In another particular aspect of this embodiment, none of the interior dimples of the first domain has the same dimple diameter as an interior dimple of the second domain. In another particular aspect of this embodiment, at least one of the interior dimples of the first domain has the same dimple diameter as a perimeter dimple of the second domain. In another particular aspect of this embodiment, at least one of the interior dimples of the second domain has the same dimple diameter as a perimeter dimple of the first domain. In another particular aspect of this embodiment, the perimeter dimples of the first domain include dimples having at least three different diameters, the interior dimples of the first domain include dimples having at least three different diameters, the perimeter dimples of the second domain include dimples having at least three different diameters, the interior dimples of the second domain include dimples having at least three different diameters, each of the perimeter dimples of the second domain has the same diameter as at least one interior dimple of the second domain, and each of the interior dimples of the second domain has the same diameter as at least one perimeter dimple of the second domain. In another particular aspect of this embodiment, none of the perimeter dimples of either domain has the minimum diameter. In another particular aspect of this embodiment, the plurality of dimples comprises dimples having four or more different diameters including a minimum dimple diameter, a maximum dimple diameter, and at least two additional dimple diameters; the perimeter dimples of the first domain include from one to ten dimples having the maximum dimple diameter; and the perimeter dimples of the second domain include from one to ten dimples having the maximum dimple diameter. In another particular aspect of this embodiment, the plurality of dimples comprises dimples having five or more different diameters, including a minimum dimple diameter, a maximum dimple diameter, and at least three additional dimple diameters; the perimeter dimples of the first domain include at least one dimple having the minimum dimple diameter; the interior dimples of the first domain include at least one dimple having the minimum dimple diameter; and the number of interior dimples of the first domain having the minimum dimple diameter is at least two times the number of perimeter dimples of the first domain having the minimum dimple diameter.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION

The present invention provides a method for arranging dimples on a golf ball surface in a pattern derived from at least one irregular domain generated from a regular or non-regular polyhedron. The method includes choosing control points of a polyhedron, connecting the control points with a non-straight sketch line, patterning the sketch line in a first manner to generate an irregular domain, optionally patterning the sketch line in a second manner to create an additional irregular domain, packing the irregular domain(s) with dimples, and tessellating the irregular domain(s) to cover the surface of the golf ball in a uniform pattern. The control points include the center of a polyhedral face, a vertex of the polyhedron, a midpoint or other point on an edge of the polyhedron, and others. The method ensures that the symmetry of the underlying polyhedron is preserved while minimizing or eliminating great circles due to parting lines from the molding process.

Figure 1A:
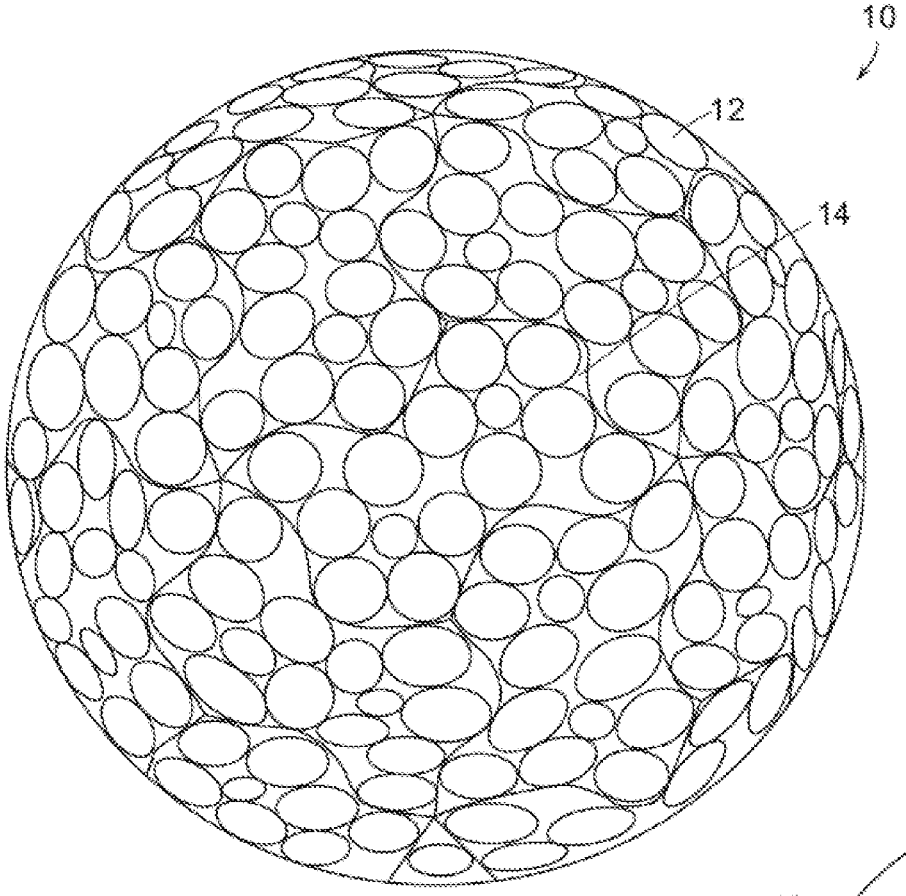
FIG. 1A illustrates a golf ball having dimples arranged by a method of the present invention.
Figure 1D:
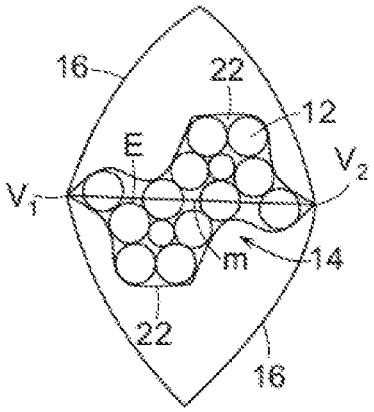
FIG. 1D illustrates a domain formed by a methods of the present invention packed with dimples and formed from two elements of FIG. 1C.

In a particular embodiment, illustrated in FIG. 1A, the present invention comprises a golf ball 10 comprising dimples 12. Dimples 12 are arranged by packing irregular domains 14 with dimples, as seen best in FIG. 1D. Irregular domains 14 are created in such a way that, when tessellated on the surface of golf ball 10, they impart greater orders of symmetry to the surface than prior art balls. The irregular shape of domains 14 additionally minimize the appearance and effect of the golf ball parting line from the molding process, and allows greater flexibility in arranging dimples than would be available with regularly shaped domains.

For purposes of the present invention, the term "irregular domains" refers to domains wherein at least one, and preferably all, of the segments defining the borders of the domain is not a straight line.

The irregular domains can be defined through the use of any one of the exemplary methods described herein. Each method produces one or more unique domains based on circumscribing a sphere with the vertices of a regular polyhedron. The vertices of the circumscribed sphere based on the vertices of the corresponding polyhedron with origin (0,0,0) are defined below in Table 1.

TABLE 1

Vertices of Circumscribed Sphere based on Corresponding Polyhedron Vertices

| Type of Polyhedron | Vertices |
|---|---|
| Tetrahedron | (+1, +1, +1); (−1, −1, +1); (−1, +1, −1); (+1, −1, −1) |
| Cube | (±1, ±1, ±1) |
| Octahedron | (±1, 0, 0); (0, ±1, 0); (0, 0, ±1) |
| Dodecahedron | (±1, ±1, ±1); (0, ±1/φ, ±φ); (±1/φ, ±φ, 0); (±φ, 0, ±1/φ)* |
| Icosahedron | (0, ±1, ±φ); (±1, ±φ, 0); (±φ, 0, ±1)* |

*$\varphi = (1 + \sqrt{5})/2$

Figure 2:
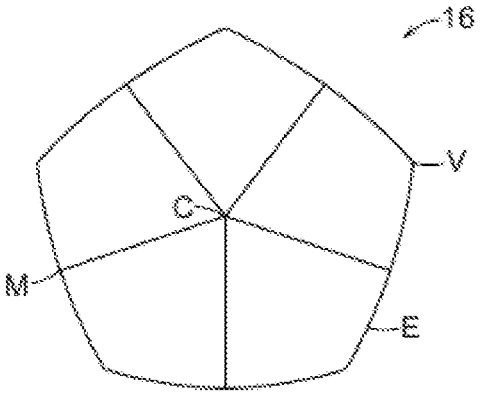
FIG. 2 illustrates a single face of a polyhedron having control points thereon.

Each method has a unique set of rules which are followed for the domain to be symmetrically patterned on the surface of the golf ball. Each method is defined by the combination of at least two control points. These control points, which are taken from one or more faces of a regular or non-regular polyhedron, consist of at least three different types: the center C of a polyhedron face; a vertex V of a face of a regular polyhedron; and the midpoint M of an edge of a face of the polyhedron. FIG. 2 shows an exemplary face 16 of a polyhedron (a regular dodecahedron in this case) and one of each a center C, a midpoint M, a vertex V, and an edge E on face 16. The two control points C, M, or V may be of the same or different types. Accordingly, six types of methods for use with regular polyhedrons are defined as follows:

1. Center to midpoint (C→M);
2. Center to center (C→C);
3. Center to vertex (C→V);
4. Midpoint to midpoint (M→M);
5. Midpoint to Vertex (M→V); and
6. Vertex to Vertex (V→V).

While each method differs in its particulars, they all follow the same basic scheme. First, a non-linear sketch line is drawn connecting the two control points. This sketch line may have any shape, including, but not limited, to an arc, a spline, two or more straight or arcuate lines or curves, or a combination thereof. Second, the sketch line is patterned in a method specific manner to create a domain, as discussed below. Third, when necessary, the sketch line is patterned in a second fashion to create a second domain.

While the basic scheme is consistent for each of the six methods, each method preferably follows different steps in order to generate the domains from a sketch line between the two control points, as described below with reference to each of the methods individually.

The Center to Vertex Method

Figure 1B:
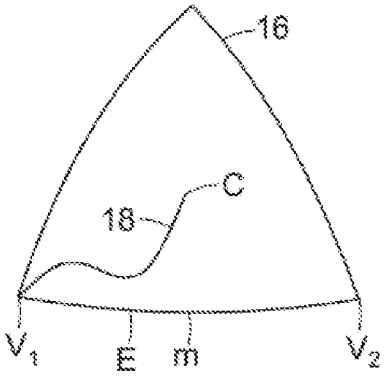
FIG. 1B illustrates a polyhedron face.
Figure 1C:
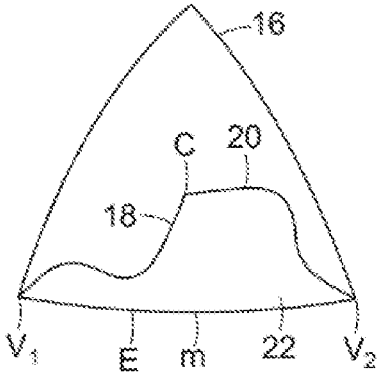
FIG. 1C illustrates an element of the present invention in the polyhedron face of FIG. 1B.

Referring again to FIGS. 1A-1D, the center to vertex method yields one domain that tessellates to cover the surface of golf ball 10. The domain is defined as follows:

1. A regular polyhedron is chosen (FIGS. 1A-1D use an icosahedron);
2. A single face 16 of the regular polyhedron is chosen, as shown in FIG. 1B;
3. Center C of face 16, and a first vertex $V_1$ of face 16 are connected with any non-linear sketch line, hereinafter referred to as a segment 18;
4. A copy 20 of segment 18 is rotated about center C, such that copy 20 connects center C with vertex $V_2$ adjacent to vertex $V_1$. The two segments 18 and 20 and the edge E connecting vertices $V_1$ and $V_2$ define an element 22, as shown best in FIG. 1C; and
5. Element 22 is rotated about midpoint M of edge E to create a domain 14, as shown best in FIG. 1D.

When domain 14 is tessellated to cover the surface of golf ball 10, as shown in FIG. 1A, a different number of total domains 14 will result depending on the regular polyhedron chosen as the basis for control points C and $V_1$. The number of domains 14 used to cover the surface of golf ball 10 is equal to the number of faces $P_F$ of the polyhedron chosen times the number of edges $P_E$ per face of the polyhedron divided by 2, as shown below in Table 2.

TABLE 2

Domains Resulting From Use of Specific Polyhedra When Using the Center to Vertex Method

| Type of Polyhedron | Number of Faces, $P_F$ | Number of Edges, $P_E$ | Number of Domains 14 |
|---|---|---|---|
| Tetrahedron | 4 | 3 | 6 |
| Cube | 6 | 4 | 12 |
| Octahedron | 8 | 3 | 12 |
| Dodecahedron | 12 | 5 | 30 |
| Icosahedron | 20 | 3 | 30 |

The Center to Midpoint Method

Figure 3C:
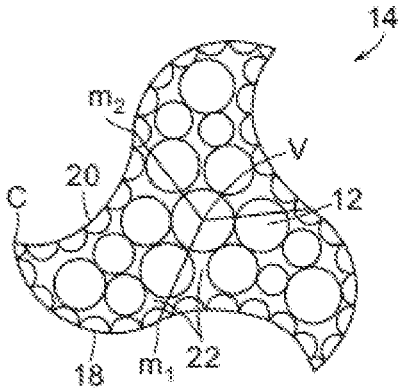
FIG. 3C illustrates a domain of the present invention packed with dimples formed from elements of FIG. 3B.
Figure 3A:
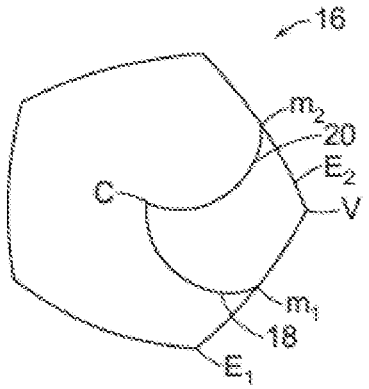
FIG. 3A illustrates a polyhedron face.

Referring to FIGS. 3A-3D, the center to midpoint method yields a single irregular domain that can be tessellated to cover the surface of golf ball 10. The domain is defined as follows:

1. A regular polyhedron is chosen (FIGS. 3A-3D use a dodecahedron);
2. A single face 16 of the regular polyhedron is chosen, as shown in FIG. 3A;
3. Center C of face 16, and midpoint $M_1$ of a first edge $E_1$ of face 16 are connected with a segment 18;
4. A copy 20 of segment 18 is rotated about center C, such that copy 20 connects center C with a midpoint $M_2$ of a second edge $E_2$ adjacent to first edge $E_1$. The two segments 16 and 18 and the portions of edge $E_1$ and edge $E_2$ between midpoints $M_1$ and $M_2$ define an element 22; and
5. Element 22 is patterned about vertex V of face 16 which is contained in element 22 and connects edges $E_1$ and $E_2$ to create a domain 14.

Figure 3D:
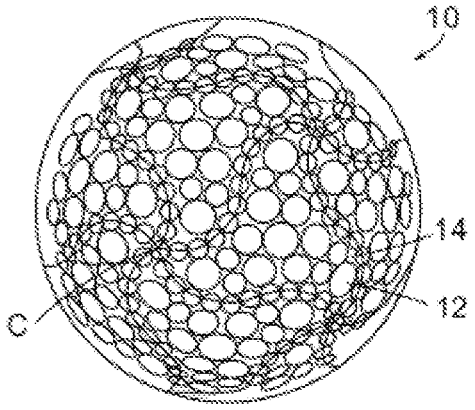
FIG. 3D illustrates a golf ball formed by a method of the present invention formed of the domain of FIG. 3C.
Figure 3B:
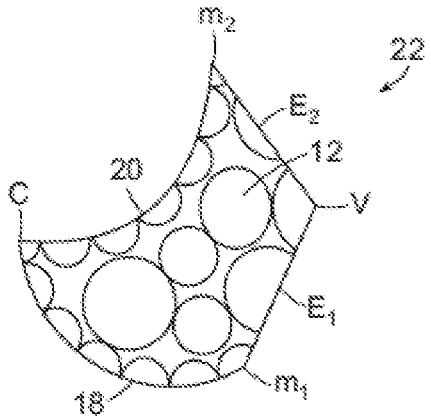
FIG. 3B illustrates an element of the present invention packed with dimples.

When domain 14 is tessellated around a golf ball 10 to cover the surface of golf ball 10, as shown in FIG. 3D, a different number of total domains 14 will result depending on the regular polyhedron chosen as the basis for control points C and $M_1$. The number of domains 14 used to cover the surface of golf ball 10 is equal to the number of vertices $P_V$ of the chosen polyhedron, as shown below in Table 3.

TABLE 3

Domains Resulting From Use of Specific Polyhedra When Using the Center to Midpoint Method

| Type of Polyhedron | Number of Vertices, $P_V$ | Number of Domains 14 |
|---|---|---|
| Tetrahedron | 4 | 4 |
| Cube | 8 | 8 |
| Octahedron | 6 | 6 |
| Dodecahedron | 20 | 20 |
| Icosahedron | 12 | 12 |

The Center to Center Method

Figure 4A:
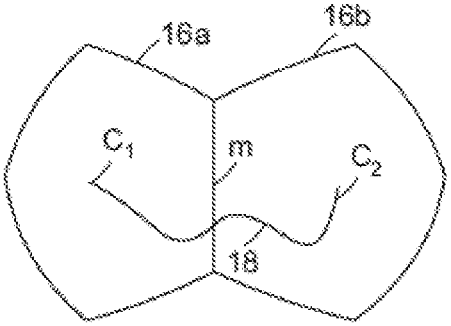
FIG. 4A illustrates two polyhedron faces.
Figure 4C:
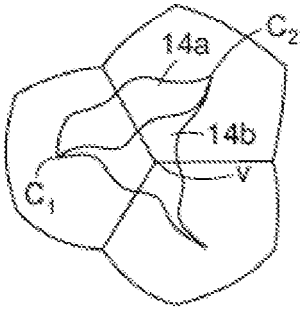
FIG. 4C illustrates a first domain and a second domain of the present invention in three polyhedron faces.
Figure 4B:
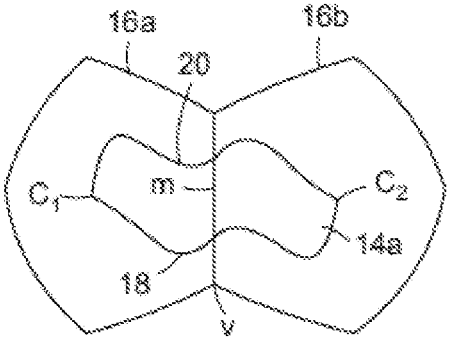
FIG. 4B illustrates a first domain of the present invention in the two polyhedron faces of FIG. 4A.

Referring to FIGS. 4A-4D, the center to center method yields two domains that can be tessellated to cover the surface of golf ball 10. The domains are defined as follows:

1. A regular polyhedron is chosen (FIGS. 4A-4D use a dodecahedron);
2. Two adjacent faces 16*a* and 16*b* of the regular polyhedron are chosen, as shown in FIG. 4A;
3. Center $C_1$ of face 16*a*, and center $C_2$ of face 16*b* are connected with a segment 18;
4. A copy 20 of segment 18 is rotated 180 degrees about the midpoint M between centers $C_1$ and $C_2$, such that copy 20 also connects center $C_1$ with center $C_2$, as shown in FIG. 4B. The two segments 16 and 18 define a first domain 14*a*; and
5. Segment 18 is rotated equally about vertex V to define a second domain 14*b*, as shown in FIG. 4C.

Figure 4D:
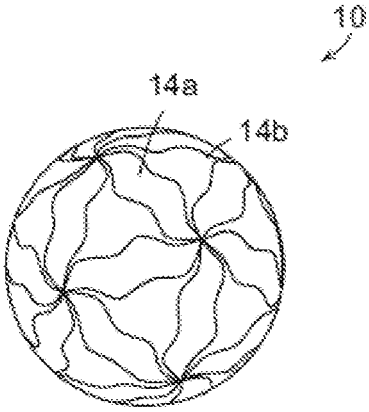
FIG. 4D illustrates a golf ball formed by a method of the present invention formed of the domains of FIG. 4C.

When first domain 14*a* and second domain 14*b* are tessellated to cover the surface of golf ball 10, as shown in FIG. 4D, a different number of total domains 14*a* and 14*b* will result depending on the regular polyhedron chosen as the basis for control points $C_1$ and $C_2$. The number of first and second domains 14*a* and 14*b* used to cover the surface of golf ball 10 is $P_F*P_E/2$ for first domain 14*a* and $P_V$ for second domain 14*b*, as shown below in Table 4.

TABLE 4

Domains Resulting From Use of Specific Polyhedra When Using the Center to Center Method

| Type of Polyhedron | Number of Vertices, $P_V$ | Number of First Domains 14a | Number of Faces, $P_F$ | Number of Edges, $P_E$ | Number of Second Domains 14b |
|---|---|---|---|---|---|
| Tetrahedron | 4 | 6 | 4 | 3 | 4 |
| Cube | 8 | 12 | 6 | 4 | 8 |
| Octahedron | 6 | 9 | 8 | 3 | 6 |
| Dodecahedron | 20 | 30 | 12 | 5 | 20 |
| Icosahedron | 12 | 18 | 20 | 3 | 12 |

The Midpoint to Midpoint Method

Figure 5A:
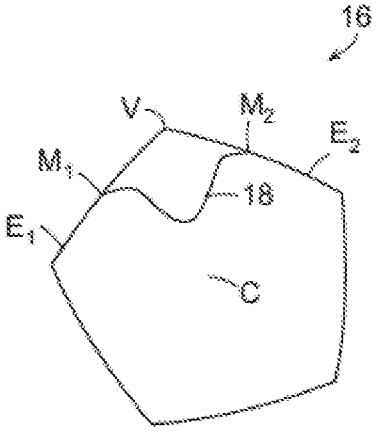
FIG. 5A illustrates a polyhedron face.
Figure 5C:
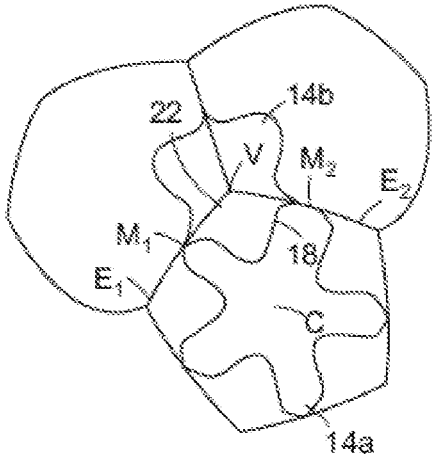
FIG. 5C illustrates a first domain and a second domain of the present invention in three polyhedron faces.
Figure 5B:
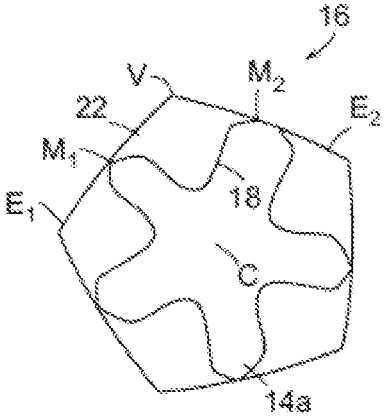
FIG. 5B illustrates a first domain of the present invention in a polyhedron face.
Figure 11A:
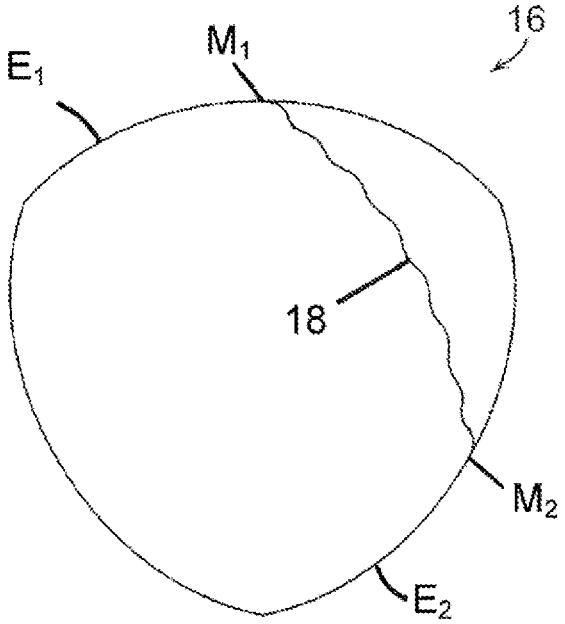
FIG. 11A illustrates a tetrahedron face projected on a sphere.
Figure 11B:
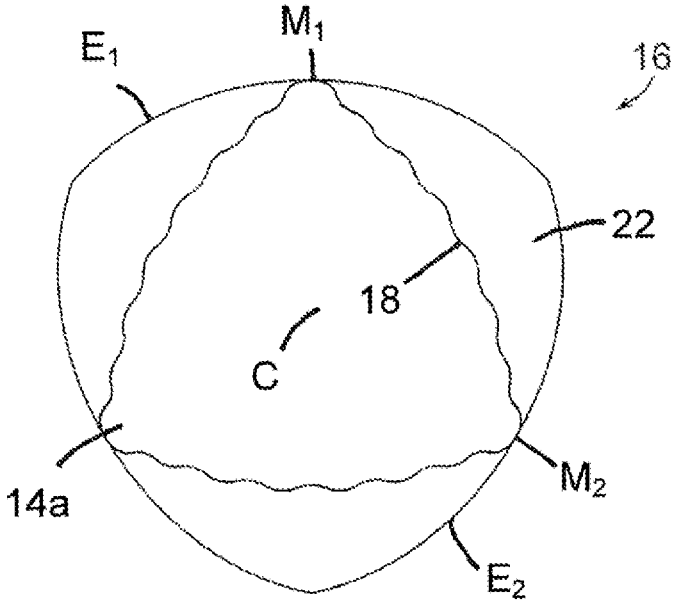
FIG. 11B illustrates a first domain of the present invention in the tetrahedron face of FIG. 11A.
Figure 11C:
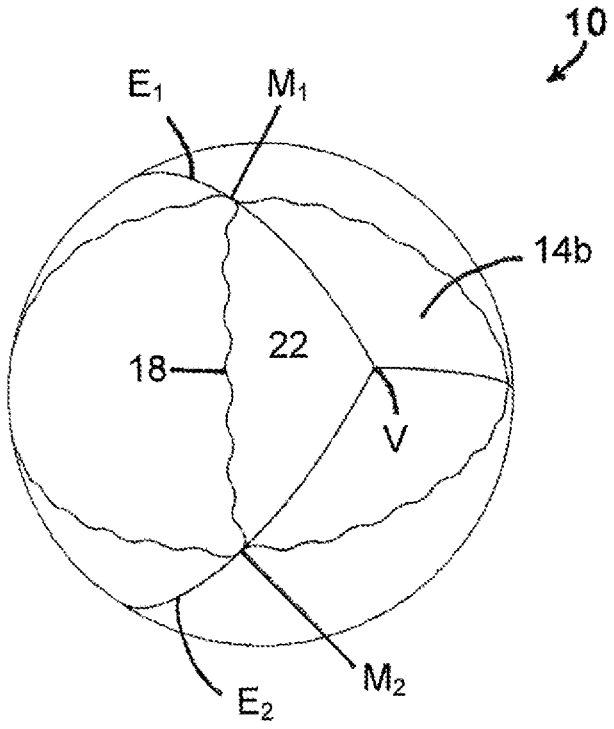
FIG. 11C illustrates a first domain and a second domain of the present invention projected on a sphere.

Referring to FIGS. 5A-5D, 11A-11X, 14A-14C, 15A-15C, 16A-16C, 17A-17C, 18A-18C, and 19A-19C, the midpoint to midpoint method yields two domains that tessellate to cover the surface of golf ball 10. The domains are defined as follows:

1. A regular polyhedron is chosen (FIGS. 5A-5D use a dodecahedron, FIGS. 11A-11X, 14A-14C, 15A-15C, 16A-16C, 17A-17C, 18A-18C, and 19A-19C use a tetrahedron);
2. A single face 16 of the regular polyhedron is projected onto a sphere, as shown in FIGS. 5A and 11A;
3. The midpoint $M_1$ of a first edge $E_1$ of face 16, and the midpoint $M_2$ of a second edge $E_2$ adjacent to first edge $E_1$ are connected with a segment 18, as shown in FIGS. 5A and 11A;
4. Segment 18 is patterned around center C of face 16, at an angle of rotation equal to $360/P_E$, to form a first domain 14*a*, as shown in FIGS. 5B and 11B;
5. Segment 18, along with the portions of first edge $E_1$ and second edge $E_2$ between midpoints $M_1$ and $M_2$, define an element 22, as shown in FIGS. 5B and 11B; and
6. Element 22 is patterned about the vertex V which connects edges $E_1$ and $E_2$ to create a second domain 14*b*, as shown in FIGS. 5C and 11C. The number of segments in the pattern that forms the second domain is equal to $P_F*P_E/P_V$.

Figure 5D:
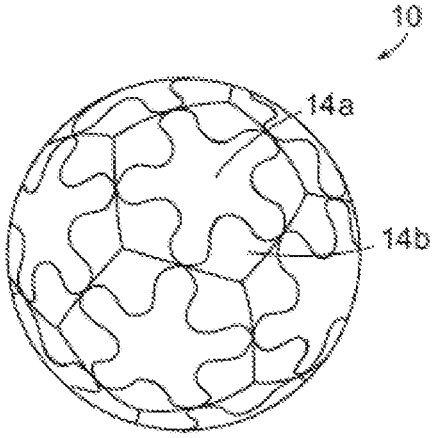
FIG. 5D illustrates a golf ball formed using a method of the present invention formed of the domains of FIG. 5C.
Figure 11D:
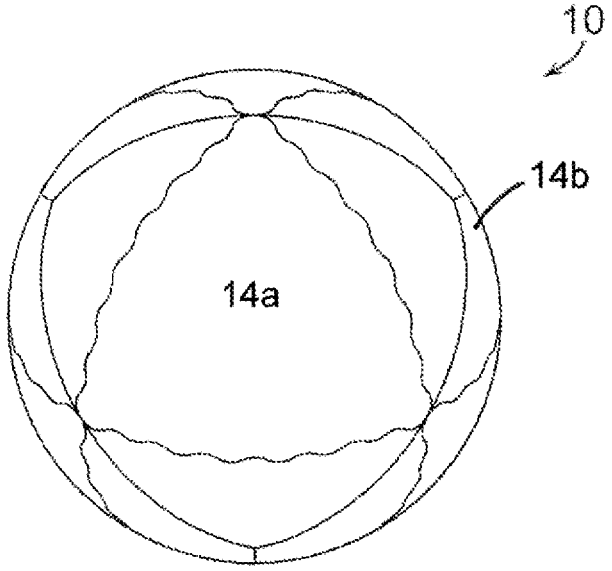
FIG. 11D illustrates the domains of FIG. 11C tessellated to cover the surface of a sphere.

When first domain 14*a* and second domain 14*b* are tessellated to cover the surface of golf ball 10, as shown in FIGS. 5D and 11D, a different number of total domains 14*a* and 14*b* will result depending on the regular polyhedron chosen as the basis for control points $M_1$ and $M_2$. The number of first and second domains 14*a* and 14*b* used to cover the surface of golf ball 10 is $P_F$ for first domain 14*a* and $P_V$ for second domain 14*b*, as shown below in Table 5.

In a particular aspect of the embodiment shown in FIGS. 11A-11X, 14A-14C, 15A-15C, 16A-16C, 17A-17C, 18A-18C, and 19A-19C, segment 18 forms a portion of a parting line of golf ball 10. Thus, segment 18, along with each copy thereof that is produced by steps 4 and 6 above, produce the real and two false parting lines of the ball when the domains are tessellated to cover the ball's surface.

TABLE 5

Domains Resulting From Use of Specific Polyhedra When Using the Midpoint to Midpoint Method

| Type of Polyhedron | Number of Faces, $P_F$ | Number of First Domains 14a | Number of Vertices, $P_V$ | Number of Second Domains 14b |
|---|---|---|---|---|
| Tetrahedron | 4 | 4 | 4 | 4 |
| Cube | 6 | 6 | 8 | 8 |
| Octahedron | 8 | 8 | 6 | 6 |
| Dodecahedron | 12 | 12 | 20 | 20 |
| Icosahedron | 20 | 20 | 12 | 12 |

The Midpoint to Vertex Method

Figure 6A:
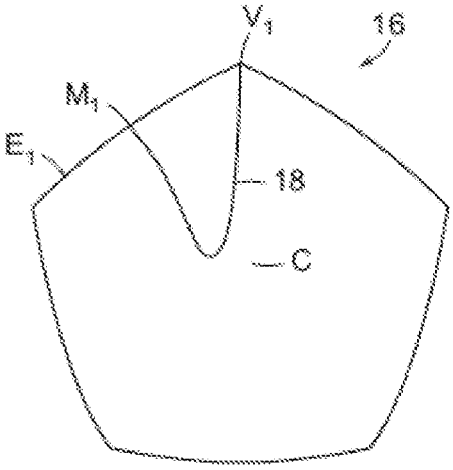
FIG. 6A illustrates a polyhedron face.
Figure 6C:
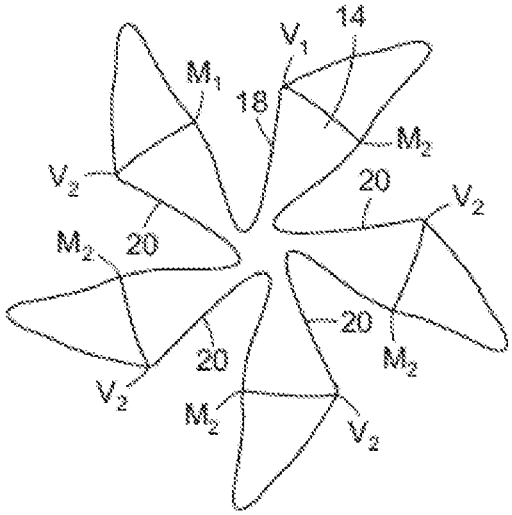
FIG. 6C illustrates a domain formed by the methods of the present invention.
Figure 6B:
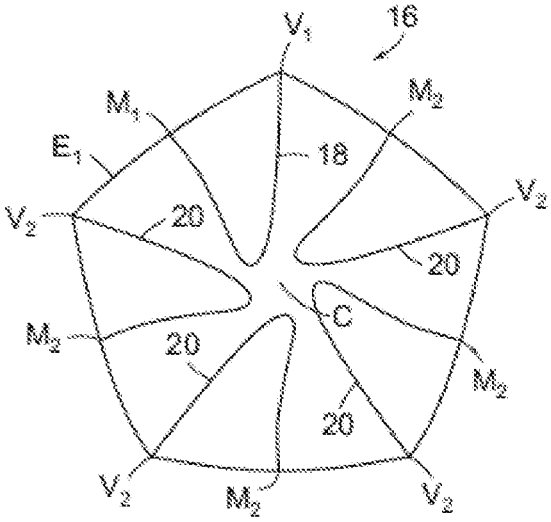
FIG. 6B illustrates a portion of a domain of the present invention in the polyhedron face of FIG. 6A.

Referring to FIGS. 6A-6D, the midpoint to vertex method yields one domain that tessellates to cover the surface of golf ball 10. The domain is defined as follows:

1. A regular polyhedron is chosen (FIGS. 6A-6D use a dodecahedron);
2. A single face 16 of the regular polyhedron is chosen, as shown in FIG. 6A;
3. A midpoint $M_1$ of edge $E_1$ of face 16 and a vertex $V_1$ on edge $E_1$ are connected with a segment 18;
4. Copies 20 of segment 18 is patterned about center C of face 16, one for each midpoint $M_2$ and vertex $V_2$ of face 16, to define a portion of domain 14, as shown in FIG. 6B; and
5. Segment 18 and copies 20 are then each rotated 180 degrees about their respective midpoints to complete domain 14, as shown in FIG. 6C.

Figure 6D:
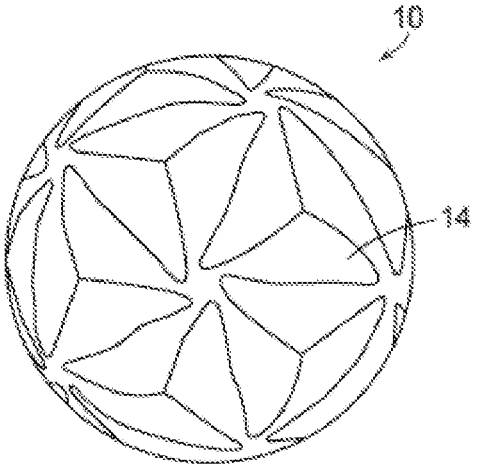
FIG. 6D illustrates a golf ball formed using the methods of the present invention formed of domains of FIG. 6C.

When domain 14 is tessellated to cover the surface of golf ball 10, as shown in FIG. 6D, a different number of total domains 14 will result depending on the regular polyhedron chosen as the basis for control points $M_1$ and $V_1$. The number of domains 14 used to cover the surface of golf ball 10 is $P_F$, as shown in Table 6.

TABLE 6

Domains Resulting From Use of Specific Polyhedra When Using the Midpoint to Vertex Method

| Type of Polyhedron | Number of Faces, $P_F$ | Number of Domains 14 |
|---|---|---|
| Tetrahedron | 4 | 4 |
| Cube | 6 | 6 |
| Octahedron | 8 | 8 |
| Dodecahedron | 12 | 12 |
| Icosahedron | 20 | 20 |

The Vertex to Vertex Method

Figure 7A:
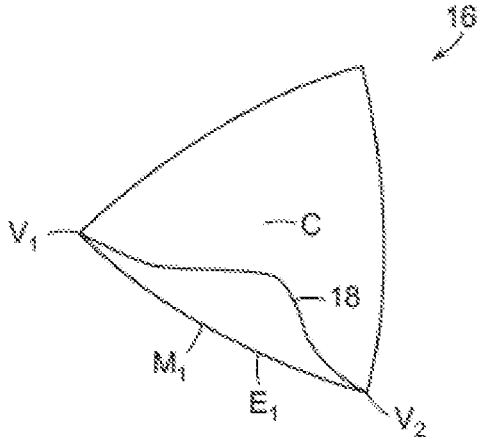
FIG. 7A illustrates a polyhedron face.
Figure 7C:
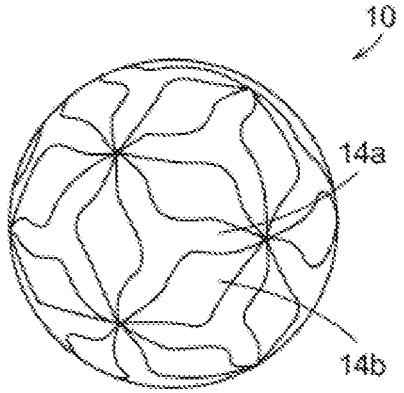
FIG. 7C illustrates a golf ball formed by a method of the present invention.
Figure 7B:
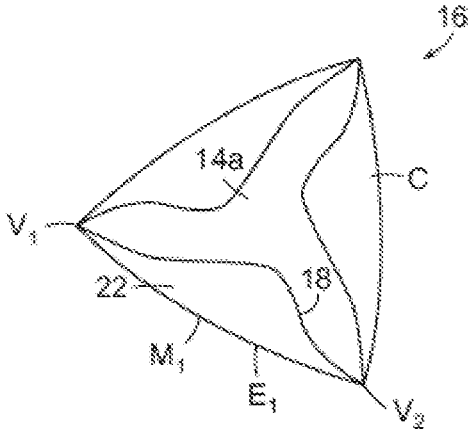
FIG. 7B illustrates a domain of the present invention in the polyhedron face of FIG. 7A.

Referring to FIGS. 7A-7C, the vertex to vertex method yields two domains that tessellate to cover the surface of golf ball 10. The domains are defined as follows:

1. A regular polyhedron is chosen (FIGS. 7A-7C use an icosahedron);
2. A single face 16 of the regular polyhedron is chosen, as shown in FIG. 7A;
3. A first vertex $V_1$ face 16, and a second vertex $V_2$ adjacent to first vertex $V_1$ are connected with a segment 18;
4. Segment 18 is patterned around center C of face 16 to form a first domain 14*a*, as shown in FIG. 7B;
5. Segment 18, along with edge $E_1$ between vertices $V_1$ and $V_2$, defines an element 22; and
6. Element 22 is rotated around midpoint $M_1$ of edge $E_1$ to create a second domain 14*b*.

When first domain 14*a* and second domain 14*b* are tessellated to cover the surface of golf ball 10, as shown in FIG. 7C, a different number of total domains 14*a* and 14*b* will result depending on the regular polyhedron chosen as the basis for control points $V_1$ and $V_2$. The number of first and second domains 14*a* and 14*b* used to cover the surface of golf ball 10 is $P_F$ for first domain 14*a* and $P_F*P_E/2$ for second domain 14*b*, as shown below in Table 7.

TABLE 7

Domains Resulting From Use of Specific Polyhedra When Using the Vertex to Vertex Method

| Type of Polyhedron | Number of Faces, $P_F$ | Number of First Domains 14a | Number of Edges per Face, $P_E$ | Number of Second Domains 14b |
|---|---|---|---|---|
| Tetrahedron | 4 | 4 | 3 | 6 |
| Cube | 6 | 6 | 4 | 12 |
| Octahedron | 8 | 8 | 3 | 12 |
| Dodecahedron | 12 | 12 | 5 | 30 |
| Icosahedron | 20 | 20 | 3 | 30 |

While the six methods previously described each make use of two control points, it is possible to create irregular domains based on more than two control points. For example, three, or even more, control points may be used. The use of additional control points allows for potentially different shapes for irregular domains. An exemplary method using a midpoint M, a center C and a vertex V as three control points for creating one irregular domain is described below.

The Midpoint to Center to Vertex Method

Figure 8A:
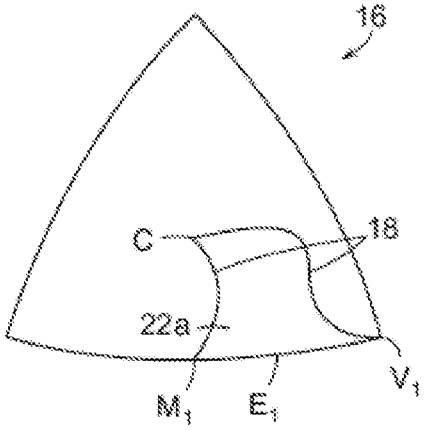
FIG. 8A illustrates a first element of the present invention in a polyhedron face.
Figure 8D:
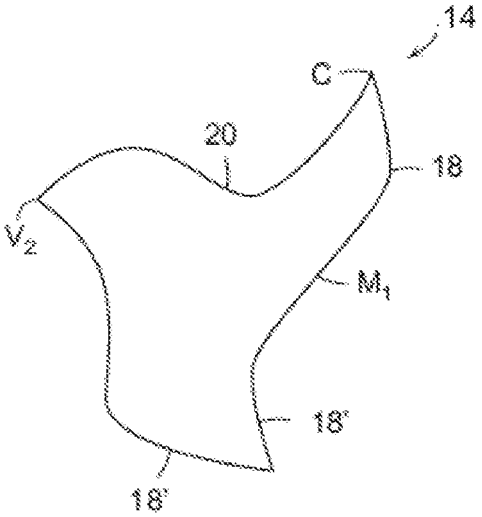
FIG. 8D illustrates a single domain of the present invention based on the two domains of FIG. 8C.
Figure 8B:
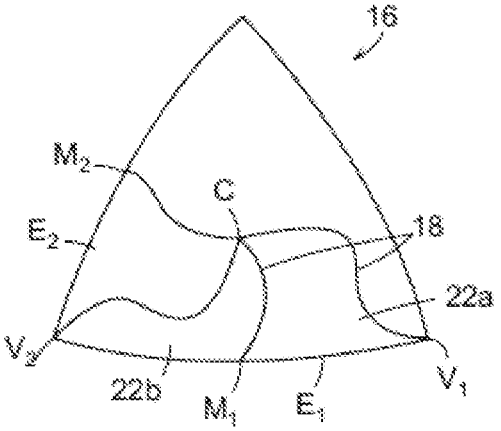
FIG. 8B illustrates a first and a second element of the present invention in the polyhedron face of FIG. 8A.

Referring to FIGS. 8A-8E, the midpoint to center to vertex method yields one domain that tessellates to cover the surface of golf ball 10. The domain is defined as follows:

1. A regular polyhedron is chosen (FIGS. 8A-8E use an icosahedron);
2. A single face 16 of the regular polyhedron is chosen, as shown in FIG. 8A;
3. A midpoint $M_1$ on edge $E_1$ of face 16, Center C of face 16 and a vertex $V_1$ on edge $E_1$ are connected with a segment 18, and segment 18 and the portion of edge $E_1$ between midpoint $M_1$ and vertex $V_1$ define a first element 22*a*, as shown in FIG. 8A;
4. A copy 20 of segment 18 is rotated about center C, such that copy 20 connects center C with a midpoint $M_2$ on edge $E_2$ adjacent to edge $E_1$, and connects center C with a vertex $V_2$ at the intersection of edges $E_1$ and $E_2$, and the portion of segment 18 between midpoint $M_1$ and center C, the portion of copy 20 between vertex $V_2$ and center C, and the portion of edge $E_1$ between midpoint $M_1$ and vertex $V_2$ define a second element 22*b*, as shown in FIG. 8B;
5. First element 22*a* and second element 22*b* are rotated about midpoint $M_1$ of edge $E_1$, as seen in FIG. 8C, to define two domains 14, wherein a single domain 14 is bounded solely by portions of segment 18 and copy 20 and the rotation 18' of segment 18, as seen in FIG. 8D.

Figure 8E:
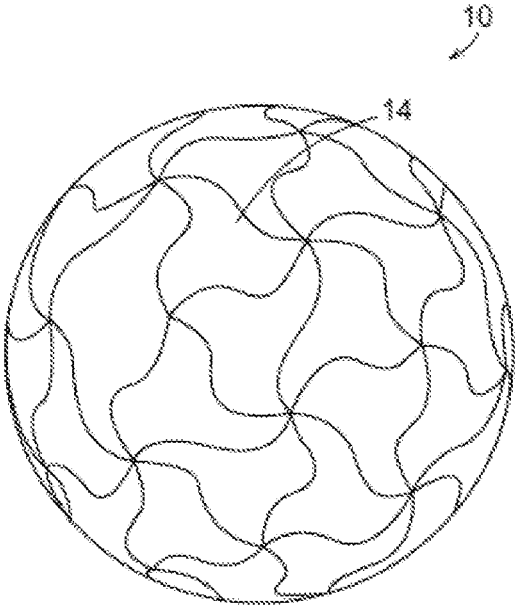
FIG. 8E illustrates a golf ball formed using a method of the present invention formed of the domains of FIG. 8D.
Figure 8C:
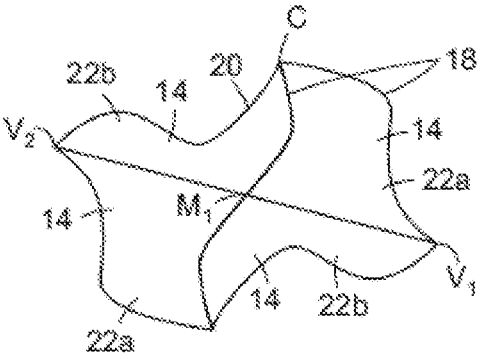
FIG. 8C illustrates two domains of the present invention composed of first and second elements of FIG. 8B.

When domain 14 is tessellated to cover the surface of golf ball 10, as shown in FIG. 8E, a different number of total domains 14 will result depending on the regular polyhedron chosen as the basis for control points M, C, and V. The number of domains 14 used to cover the surface of golf ball 10 is equal to the number of faces $P_F$ of the polyhedron chosen times the number of edges $P_E$ per face of the polyhedron, as shown below in Table 8.

TABLE 8

Domains Resulting From Use of Specific Polyhedra When Using the Midpoint to Center to Vertex Method

| Type of Polyhedron | Number of Faces, $P_F$ | Number of Edges, $P_E$ | Number of Domains 14 |
|---|---|---|---|
| Tetrahedron | 4 | 3 | 12 |
| Cube | 6 | 4 | 24 |
| Octahedron | 8 | 3 | 24 |
| Dodecahedron | 12 | 5 | 60 |
| Icosahedron | 20 | 3 | 60 |

While the methods described previously provide a framework for the use of center C, vertex V, and midpoint M as the only control points, other control points are useable. For example, a control point may be any point P on an edge E of the chosen polyhedron face. When this type of control point is used, additional types of domains may be generated, though the mechanism for creating the irregular domain(s) may be different. An exemplary method, using a center C and a point P on an edge, for creating one such irregular domain is described below.

The Center to Edge Method

Figure 9A:
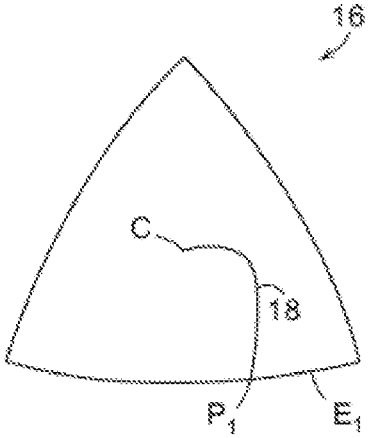
FIG. 9A illustrates a polyhedron face.
Figure 9D:
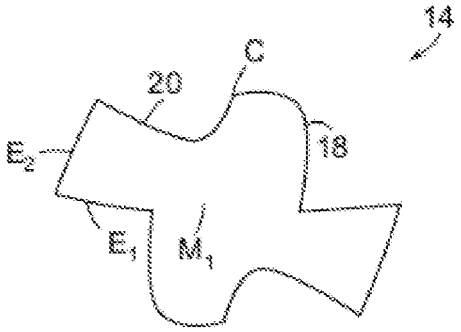
FIG. 9D illustrates a domain formed by the methods of the present invention based on the elements of FIG. 9C.
Figure 9B:
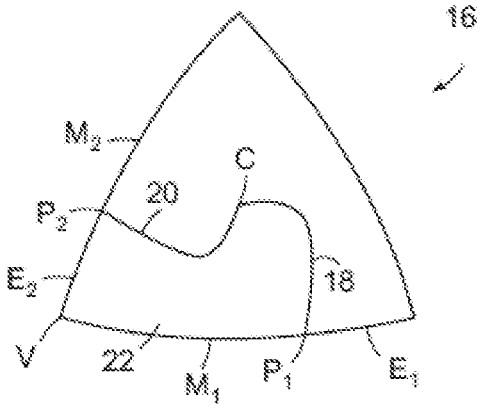
FIG. 9B illustrates an element of the present invention in the polyhedron face of FIG. 9A.

Referring to FIGS. 9A-9E, the center to edge method yields one domain that tessellates to cover the surface of golf ball 10. The domain is defined as follows:

1. A regular polyhedron is chosen (FIGS. 9A-9E use an icosahedron);
2. A single face 16 of the regular polyhedron is chosen, as shown in FIG. 9A;

3. Center C of face 16, and a point $P_1$ on edge $E_1$ are connected with a segment 18;
4. A copy 20 of segment 18 is rotated about center C, such that copy 20 connects center C with a point $P_2$ on edge $E_2$ adjacent to edge $E_1$, where point $P_2$ is positioned identically relative to edge $E_2$ as point $P_1$ is positioned relative to edge $E_1$, such that the two segments 18 and 20 and the portions of edges $E_1$ and $E_2$ between points $P_1$ and $P_2$, respectively, and a vertex V, which connects edges $E_1$ and $E_2$, define an element 22, as shown best in FIG. 9B; and
5. Element 22 is rotated about midpoint $M_1$ of edge $E_1$ or midpoint $M_2$ of edge $E_2$, whichever is located within element 22, as seen in FIGS. 9B-9C, to create a domain 14, as seen in FIG. 9D.

Figure 9E:
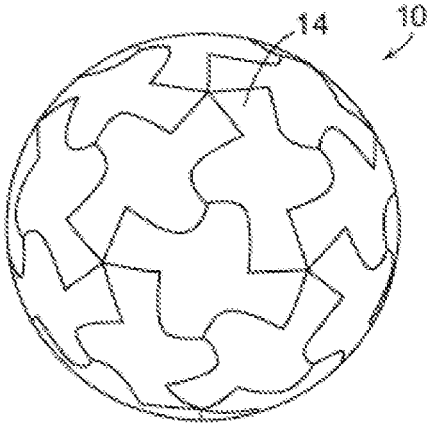
FIG. 9E illustrates a golf ball formed using a method of the present invention formed of domains of FIG. 9D.
Figure 9C:
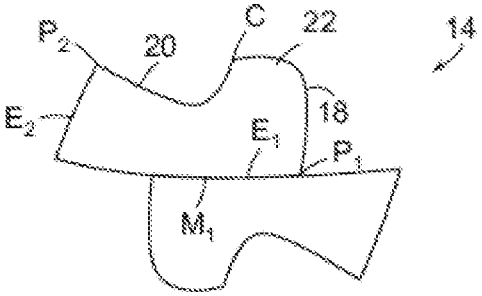
FIG. 9C illustrates two elements of FIG. 9B combining to form a domain of the present invention.

When domain 14 is tessellated to cover the surface of golf ball 10, as shown in FIG. 9E, a different number of total domains 14 will result depending on the regular polyhedron chosen as the basis for control points C and $P_1$. The number of domains 14 used to cover the surface of golf ball 10 is equal to the number of faces $P_F$ of the polyhedron chosen times the number of edges $P_E$ per face of the polyhedron divided by 2, as shown below in Table 9.

TABLE 9

Domains Resulting From Use of Specific Polyhedra When Using the Center to Edge Method

| Type of Polyhedron | Number of Faces, $P_F$ | Number of Edges, $P_E$ | Number of Domains 14 |
|---|---|---|---|
| Tetrahedron | 4 | 3 | 6 |
| Cube | 6 | 4 | 12 |
| Octahedron | 8 | 3 | 12 |
| Dodecahedron | 12 | 5 | 30 |
| Icosahedron | 20 | 3 | 30 |

Though each of the above described methods has been explained with reference to regular polyhedrons, they may also be used with certain non-regular polyhedrons, such as Archimedean Solids, Catalan Solids, or others. The methods used to derive the irregular domains will generally require some modification in order to account for the non-regular face shapes of the non-regular solids. An exemplary method for use with a Catalan Solid, specifically a rhombic dodecahedron, is described below.

A Vertex to Vertex Method for a Rhombic Dodecahedron

Figure 10A:
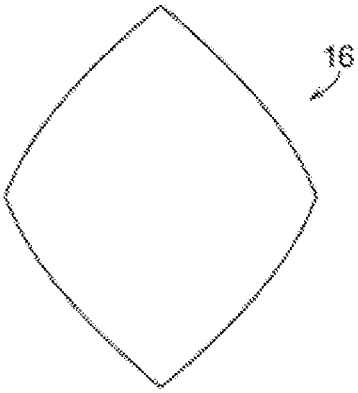
FIG. 10A illustrates a face of a rhombic dodecahedron.
Figure 10D:
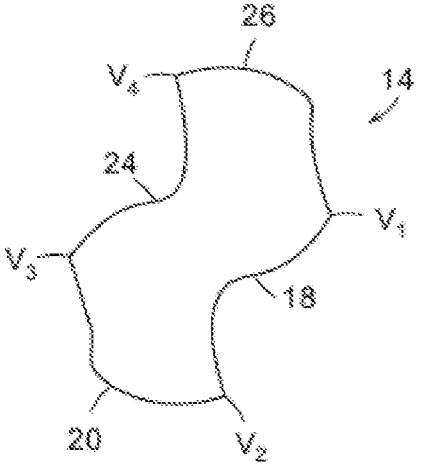
FIG. 10D illustrates a domain formed by a method of the present invention based on the segments of FIG. 10C.
Figure 10B:
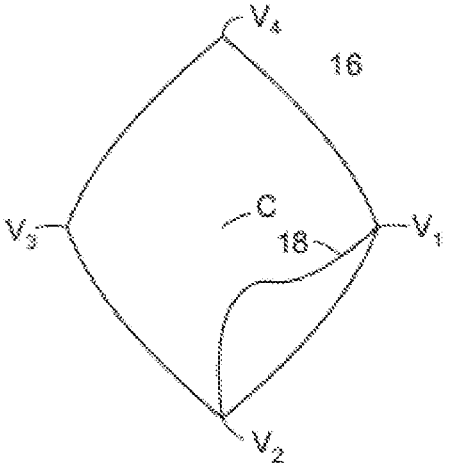
FIG. 10B illustrates a segment of the present invention in the face of FIG. 10A.
Figure 10E:
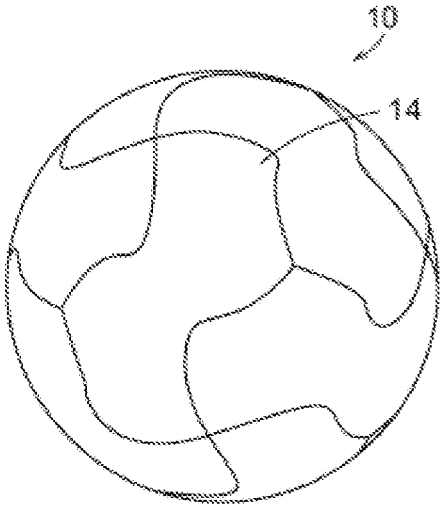
FIG. 10E illustrates a golf ball formed by a method of the present invention formed of domains of FIG. 10D.
Figure 10C:
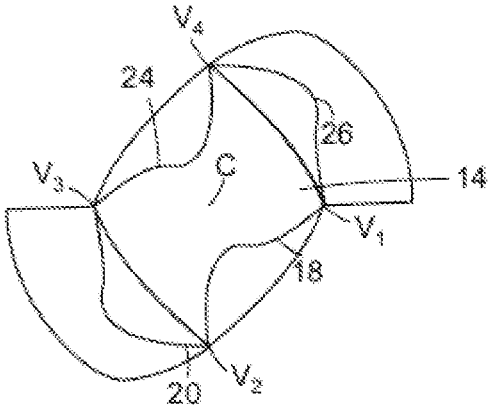
FIG. 10C illustrates the segment of FIG. 10B and copies thereof forming a domain of the present invention.

Referring to FIGS. 10A-10E, a vertex to vertex method based on a rhombic dodecahedron yields one domain that tessellates to cover the surface of golf ball 10. The domain is defined as follows:

1. A single face 16 of the rhombic dodecahedron is chosen, as shown in FIG. 10A;
2. A first vertex $V_1$ face 16, and a second vertex $V_2$ adjacent to first vertex $V_1$ are connected with a segment 18, as shown in FIG. 10B;
3. A first copy 20 of segment 18 is rotated about vertex $V_2$, such that it connects vertex $V_2$ to vertex $V_3$ of face 16, a second copy 24 of segment 18 is rotated about center C, such that it connects vertex $V_3$ and vertex $V_4$ of face 16, and a third copy 26 of segment 18 is rotated about vertex $V_1$ such that it connects vertex $V_1$ to vertex $V_4$, all as shown in FIG. 10C, to form a domain 14, as shown in FIG. 10D;

When domain 14 is tessellated to cover the surface of golf ball 10, as shown in FIG. 10E, twelve domains will be used to cover the surface of golf ball 10, one for each face of the rhombic dodecahedron.

After the irregular domain(s) are created using any of the above methods, the domain(s) may be packed with dimples in order to be usable in creating golf ball 10.

Figure 11E:
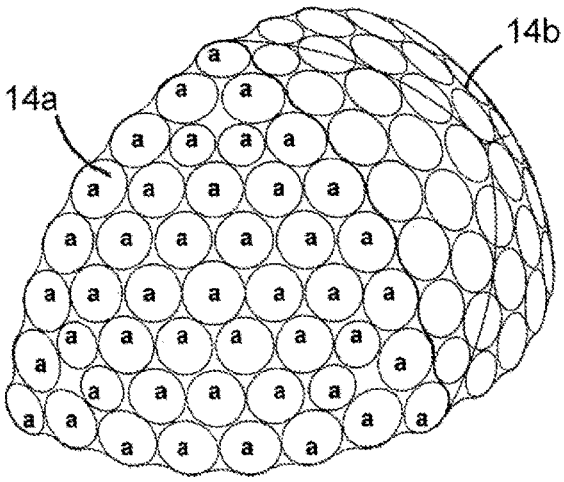
FIG. 11E illustrates a portion of a golf ball formed using a method of the present invention.
Figure 11F:
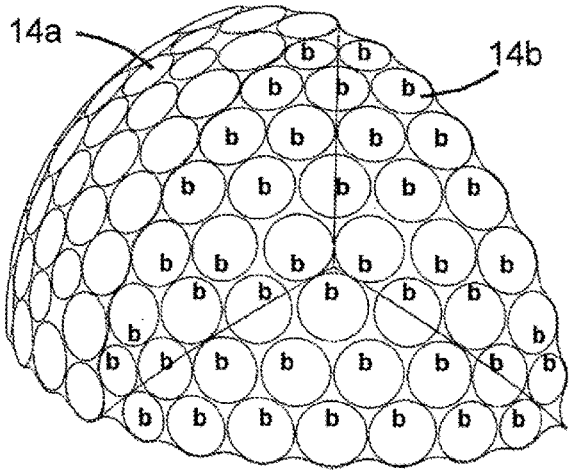
FIG. 11F illustrates another portion of a golf ball formed using a method of the present invention.
Figure 11G:
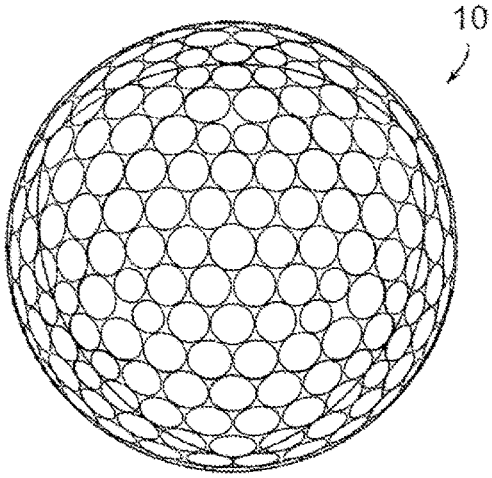
FIG. 11G illustrates a golf ball formed using a method of the present invention.

In FIGS. 11E-11X, 14A-14C, 15A-15C, 16A-16C, 17A-17C, 18A-18C, and 19A-19C, a first domain and a second domain are created using the midpoint to midpoint method based on a tetrahedron. FIG. 11E shows a first domain 14*a* and a portion of a second domain 14*b* packed with dimples, with the dimples of the first domain 14*a* designated by the letter a. FIG. 11F shows a second domain 14*b* and a portion of a first domain 14*a* packed with dimples, with the dimples of the second domain 14*b* designated by the letter b. FIG. 11G shows a first domain 14*a* and a second domain 14*b* packed with dimples and tessellated to cover the surface of golf ball 10.

Figure 11H:
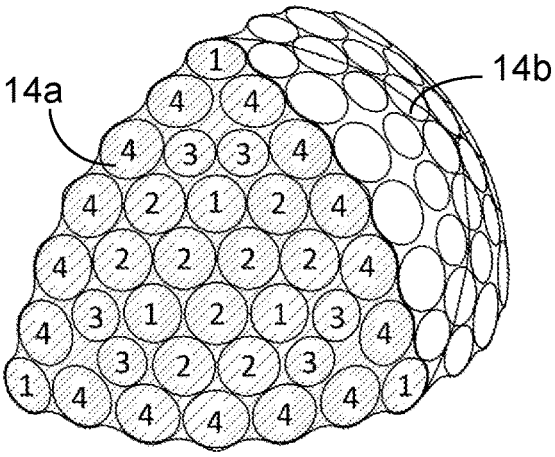
FIG. 11H illustrates a portion of a golf ball formed using a method of the present invention.
Figure 11I:
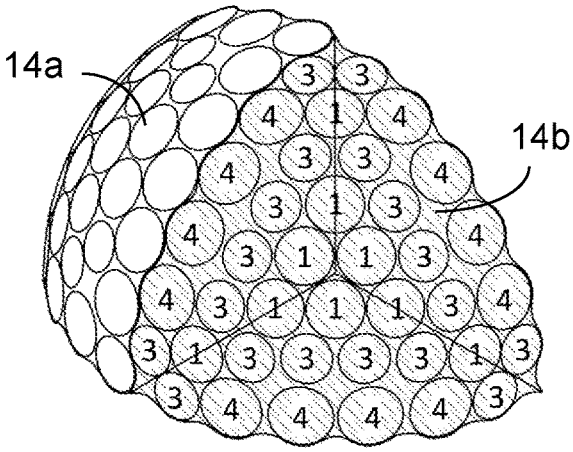
FIG. 11I illustrates another portion of a golf ball formed using a method of the present invention.
Figure 11J:
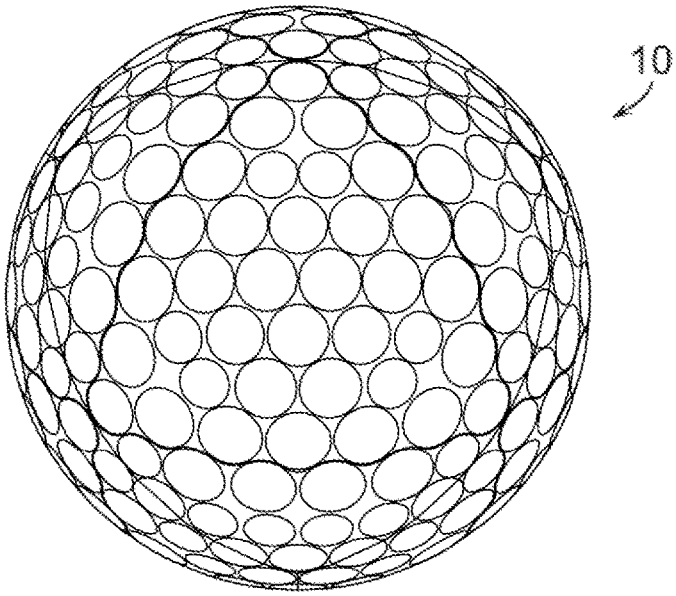
FIG. 11J illustrates a golf ball formed using a method of the present invention.

FIG. 11H shows a first domain 14*a* packed with dimples and a portion of a second domain 14*b* packed with dimples, but the dimples are packed within the domains in different patterns than those shown in FIG. 11E. In FIG. 11H, the first domain 14*a* is designated by shading. FIG. 11I shows the second domain 14*b* and a portion of the first domain 14*a* with the dimples packed within the domains in the same pattern as that shown in FIG. 11H. In FIG. 11I, the second domain 14*b* is designated by shading. FIG. 11J shows the first and second domains packed with dimples according to the embodiment shown in FIGS. 11H and 11I tessellated to cover the surface of golf ball 10.

Figure 11K:
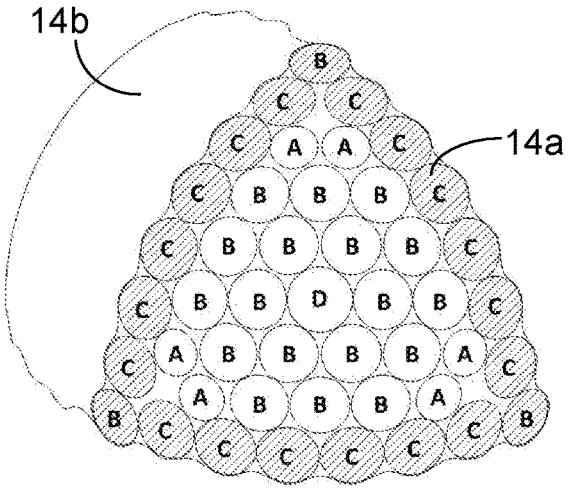
FIG. 11K illustrates a portion of a golf ball formed using a method of the present invention.
Figure 11L:
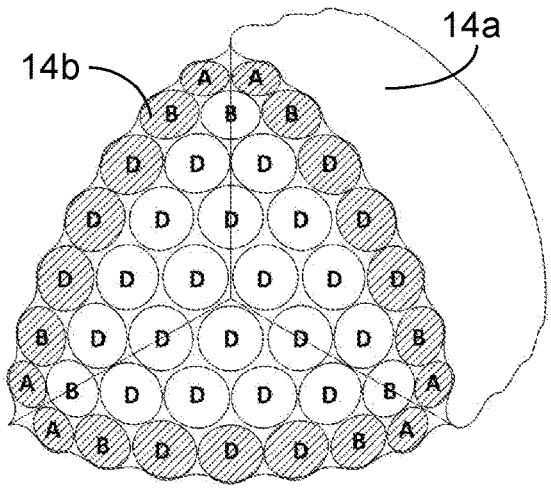
FIG. 11L illustrates another portion of a golf ball formed using a method of the present invention.
Figure 11M:
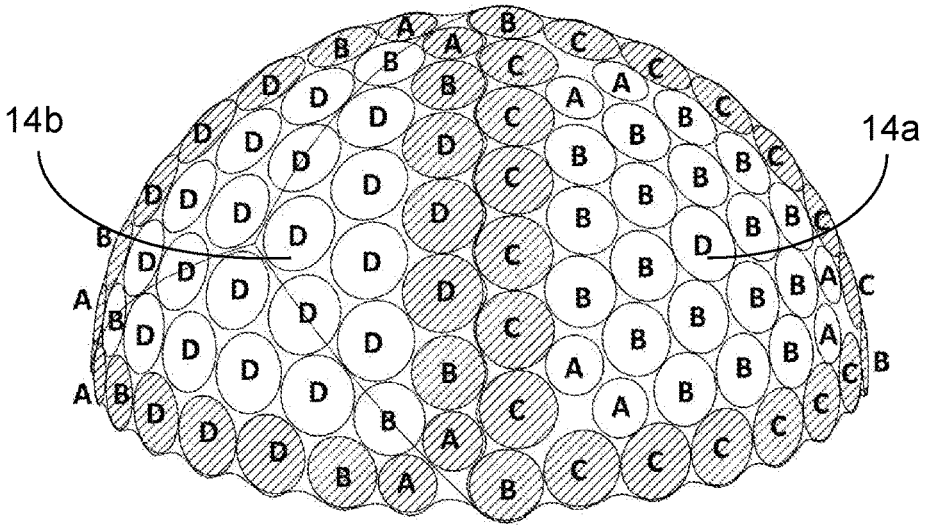
FIG. 11M illustrates another portion of a golf ball formed using a method of the present invention.

FIG. 11K shows a first domain 14*a* packed with dimples and a portion of a second domain 14*b*. FIG. 11L shows the second domain 14*b* packed with dimples and a portion of the first domain 14*a*. FIG. 11M shows the first and second domains packed with dimples according to the embodiments shown in FIGS. 11K and 11L.

Figure 11N:
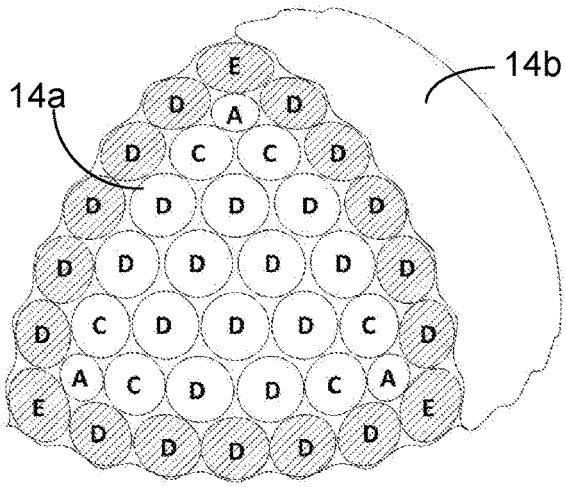
FIG. 11N illustrates a portion of a golf ball formed using a method of the present invention.
Figure 11O:
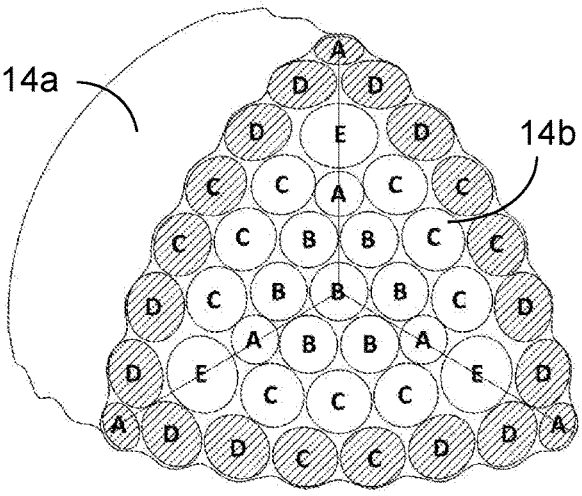
FIG. 11O illustrates another portion of a golf ball formed using a method of the present invention.
Figure 11P:
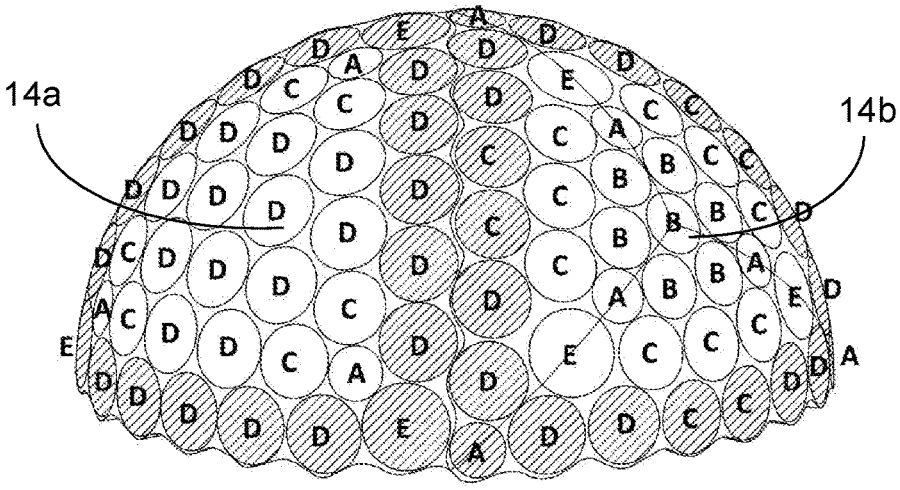
FIG. 11P illustrates another portion of a golf ball formed using a method of the present invention.

FIG. 11N shows a first domain 14*a* packed with dimples and a portion of a second domain 14*b*. FIG. 11O shows the second domain 14*b* packed with dimples and a portion of the first domain 14*a*. FIG. 11P shows the first and second domains packed with dimples according to the embodiments shown in FIGS. 11N and 11O.

Figure 11Q:
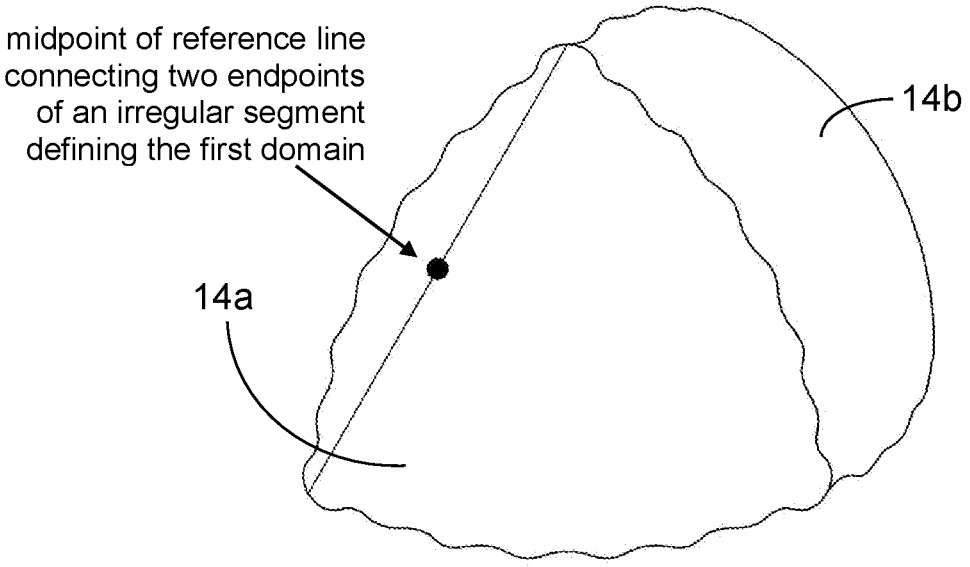
FIG. 11Q illustrates a first domain and a portion of a second domain according to an embodiment of the present invention.
Figure 11R:
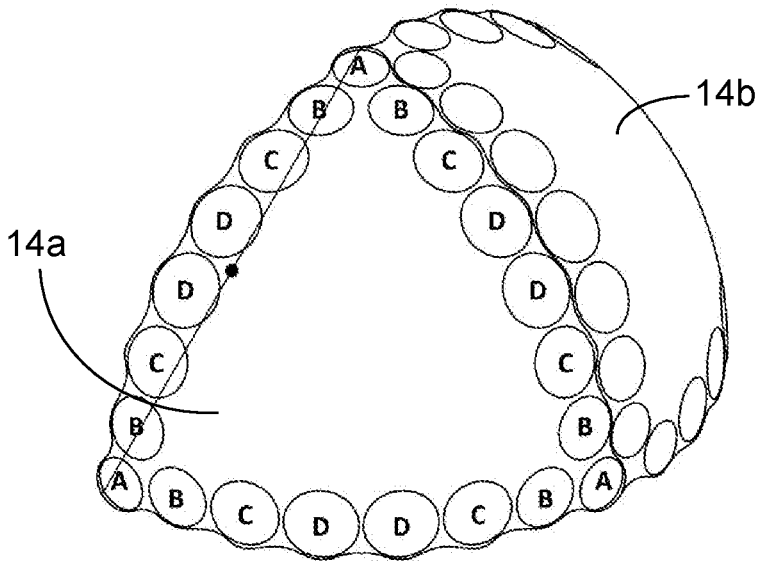
FIGS. 11R-11S illustrate a first domain with perimeter dimples and a portion of a second domain with perimeter dimples according to an embodiment of the present invention.
Figure 11S:
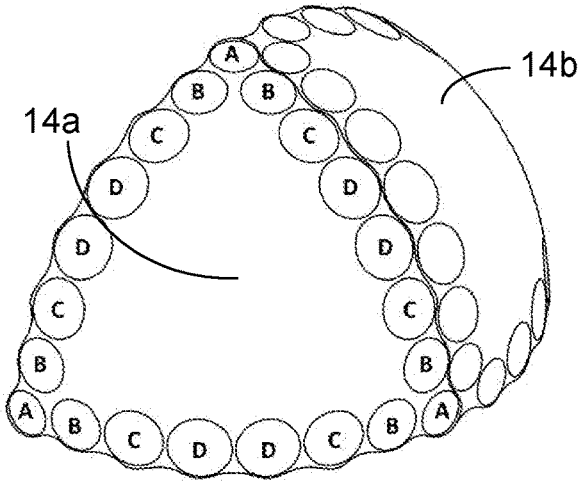
Figure 11T:
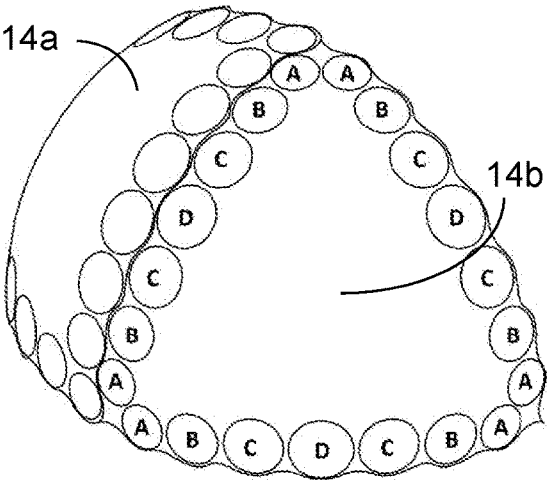
FIG. 11T illustrates a second domain with perimeter dimples and a portion of a first domain with perimeter dimples according to an embodiment of the present invention.
Figure 11U:
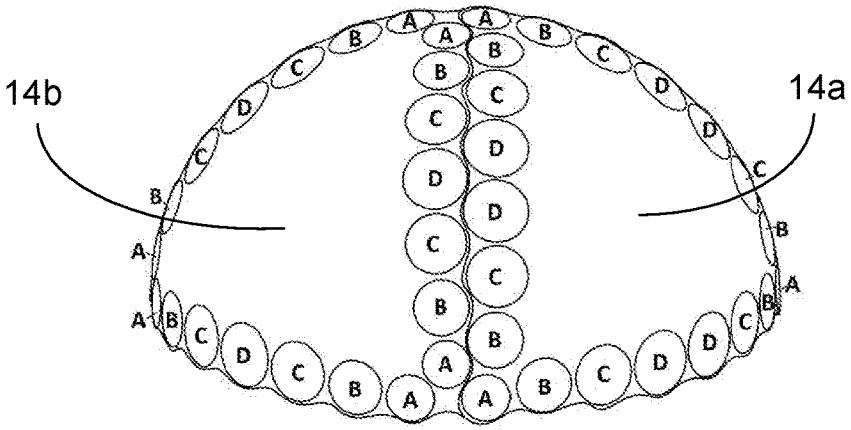
FIG. 11U illustrates the first domain and second domain of FIGS. 11R-11T.

FIG. 11S shows a first domain 14*a* packed with perimeter dimples and a portion of a second domain 14*b* packed with perimeter dimples. FIG. 11T shows the second domain 14*b* packed with perimeter dimples and a portion of the first domain 14*a* packed with perimeter dimples. FIG. 11U shows the first and second domains packed with perimeter dimples according to the embodiments shown in FIGS. 11S and 11T.

Figure 11V:
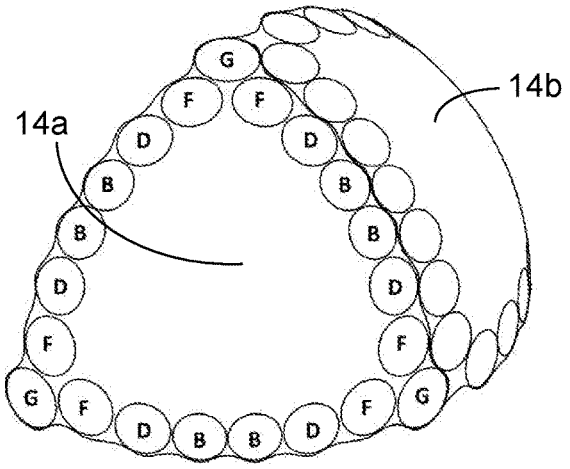
FIG. 11V illustrates a first domain with perimeter dimples and a portion of a second domain with perimeter dimples according to an embodiment of the present invention.
Figure 11W:
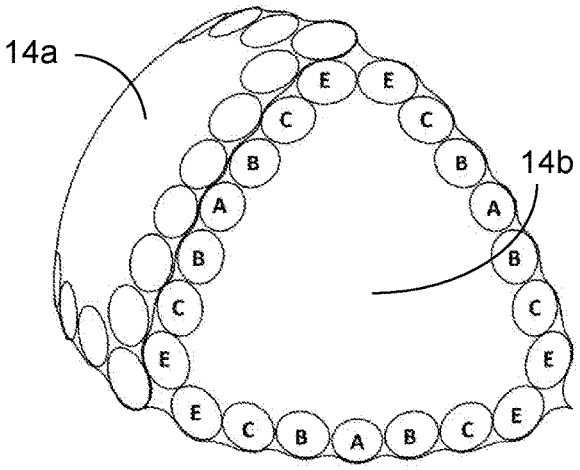
FIG. 11W illustrates a second domain with perimeter dimples and a portion of a first domain with perimeter dimples according to an embodiment of the present invention.
Figure 11X:
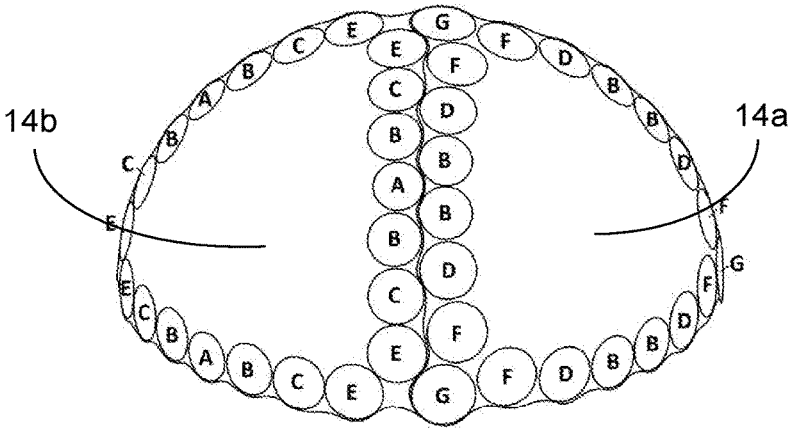
FIG. 11X illustrates the first domain and second domain of FIGS. 11V-11W.

FIG. 11V shows a first domain 14*a* packed with perimeter dimples and a portion of a second domain 14*b* packed with perimeter dimples. FIG. 11W shows the second domain 14*b* packed with perimeter dimples and a portion of the first domain 14*a* packed with perimeter dimples. FIG. 11X shows the first and second domains packed with perimeter dimples according to the embodiments shown in FIGS. 11V and 11W.

Figure 14A:
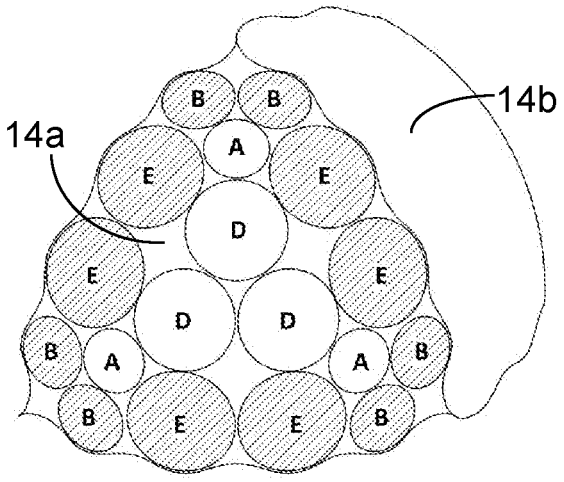
FIG. 14A illustrates a first domain with dimples and a portion of a second domain according to an embodiment of the present invention.
Figure 14B:
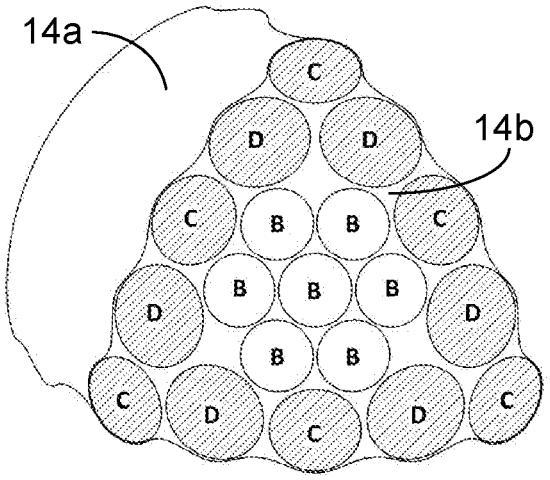
FIG. 14B illustrates a second domain with dimples and a portion of a first domain according to an embodiment of the present invention.
Figure 14C:
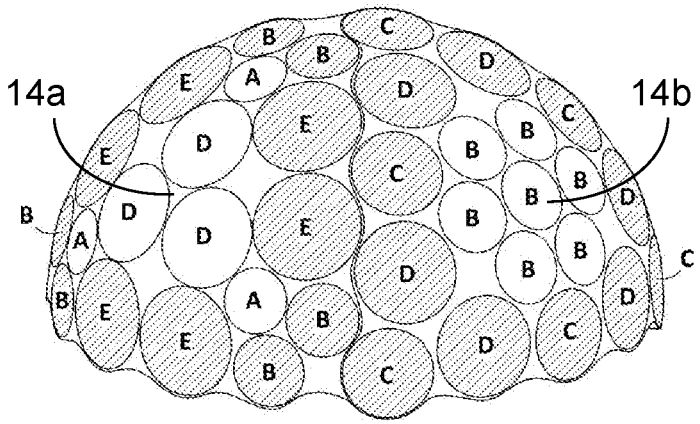
FIG. 14C illustrates a portion of a golf ball according to an embodiment of the present invention.

FIG. 14A shows a first domain 14*a* packed with dimples and a portion of a second domain 14*b*. FIG. 14B shows the second domain 14*b* packed with dimples and a portion of the first domain 14*a*. FIG. 14C shows the first and second domains packed with dimples according to the embodiments shown in FIGS. 14A and 14B.

Figure 15A:
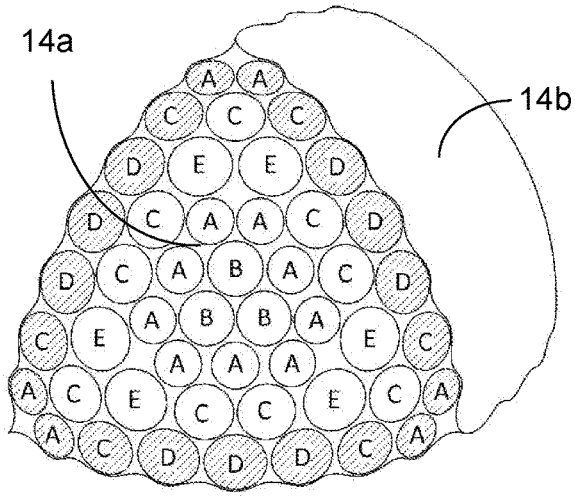
FIG. 15A illustrates a first domain with dimples and a portion of a second domain according to an embodiment of the present invention.
Figure 15B:
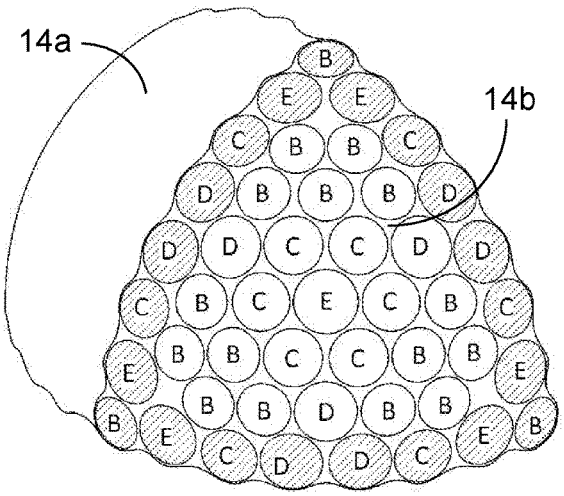
FIG. 15B illustrates a second domain with dimples and a portion of a first domain according to an embodiment of the present invention.
Figure 15C:
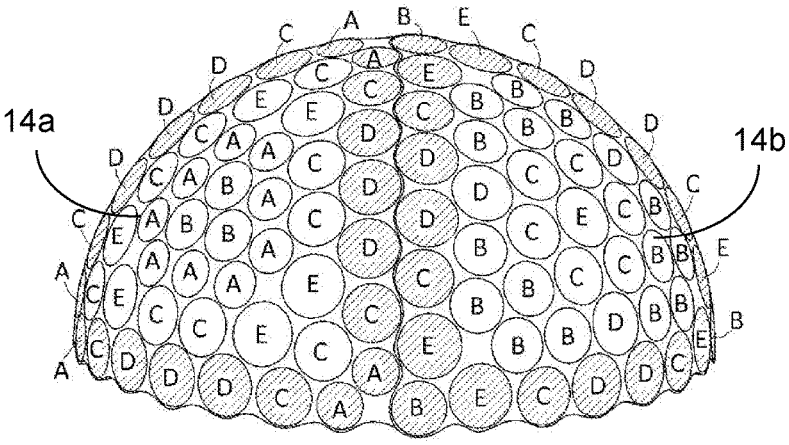
FIG. 15C illustrates a portion of a golf ball according to an embodiment of the present invention.

FIG. 15A shows a first domain 14*a* packed with dimples and a portion of a second domain 14*b*. FIG. 15B shows the second domain 14*b* packed with dimples and a portion of the first domain 14*a*. FIG. 15C shows the first and second domains packed with dimples according to the embodiments shown in FIGS. 15A and 15B.

Figure 16A:
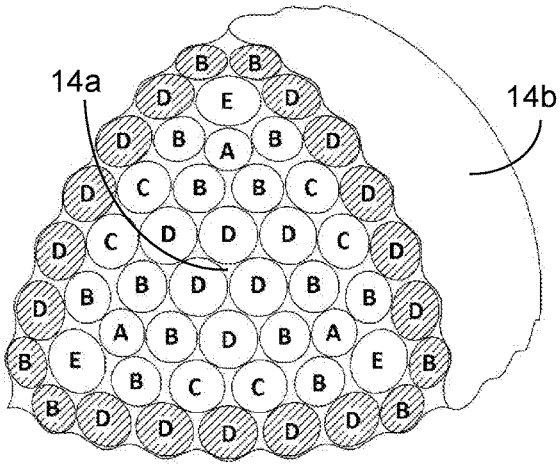
FIG. 16A illustrates a first domain with dimples and a portion of a second domain according to an embodiment of the present invention.
Figure 16B:
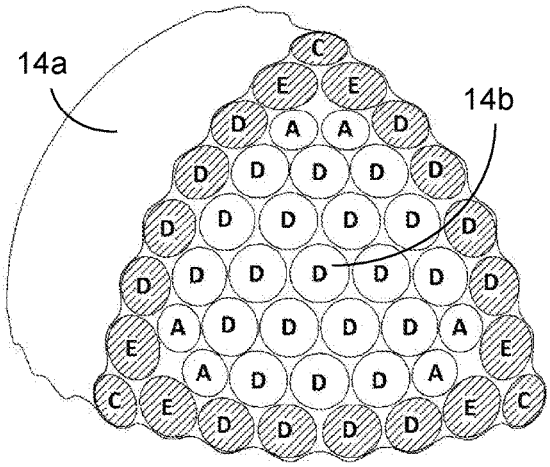
FIG. 16B illustrates a second domain with dimples and a portion of a first domain according to an embodiment of the present invention.
Figure 16C:
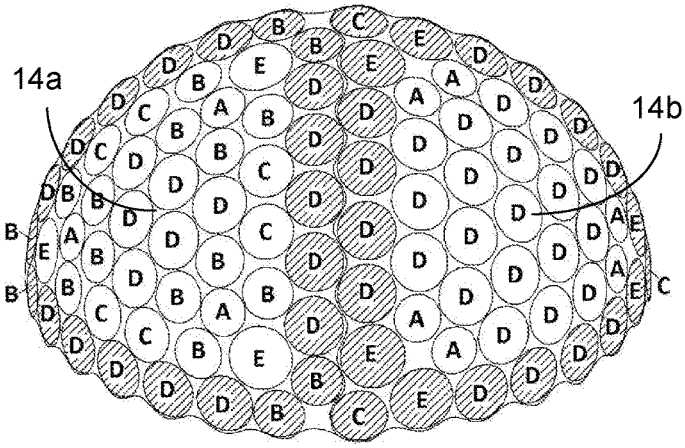
FIG. 16C illustrates a portion of a golf ball according to an embodiment of the present invention.

FIG. 16A shows a first domain 14*a* packed with dimples and a portion of a second domain 14*b*. FIG. 16B shows the second domain 14*b* packed with dimples and a portion of the first domain 14*a*. FIG. 16C shows the first and second domains packed with dimples according to the embodiments shown in FIGS. 16A and 16B.

Figure 17A:
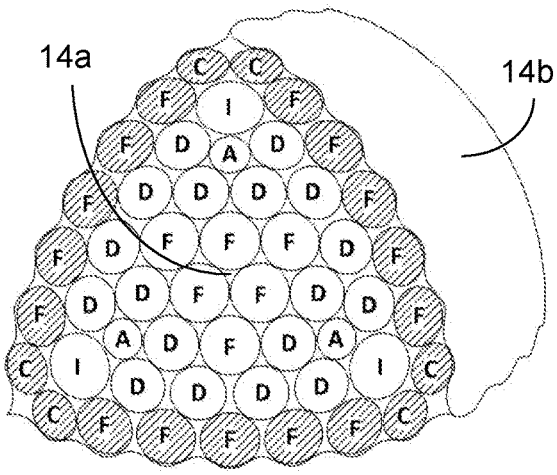
FIG. 17A illustrates a first domain with dimples and a portion of a second domain according to an embodiment of the present invention.
Figure 17B:
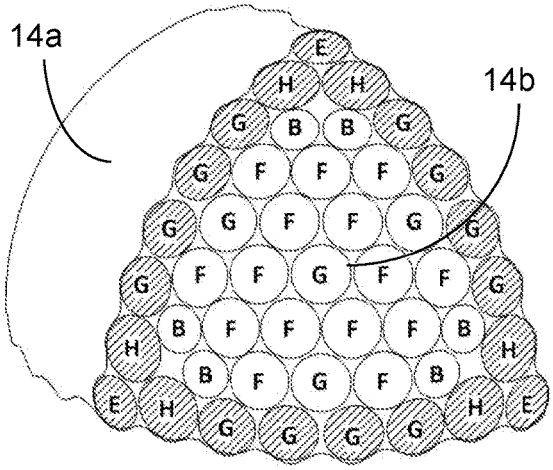
FIG. 17B illustrates a second domain with dimples and a portion of a first domain according to an embodiment of the present invention.
Figure 17C:
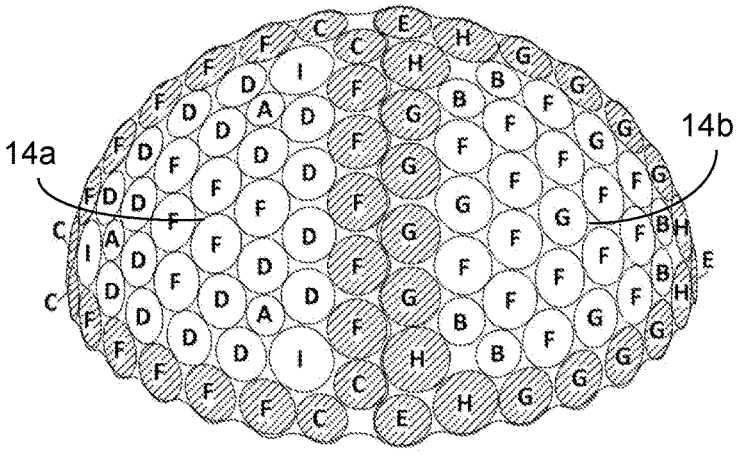
FIG. 17C illustrates a portion of a golf ball according to an embodiment of the present invention.

FIG. 17A shows a first domain 14*a* packed with dimples and a portion of a second domain 14*b*. FIG. 17B shows the second domain 14*b* packed with dimples and a portion of the first domain 14*a*. FIG. 17C shows the first and second domains packed with dimples according to the embodiments shown in FIGS. 17A and 17B.

Figure 18A:
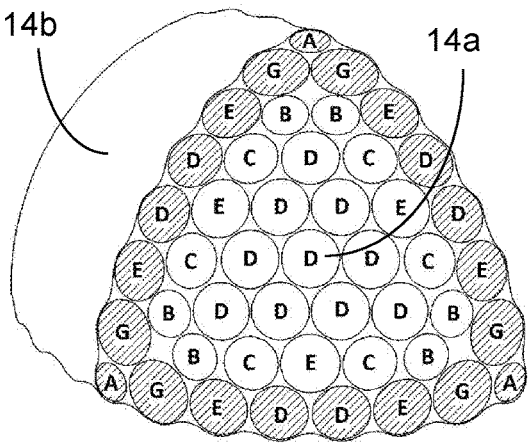
FIG. 18A illustrates a first domain with dimples and a portion of a second domain according to an embodiment of the present invention.
Figure 18B:
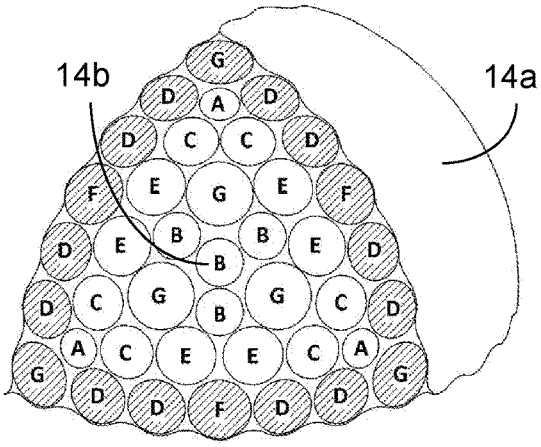
FIG. 18B illustrates a second domain with dimples and a portion of a first domain according to an embodiment of the present invention.
Figure 18C:
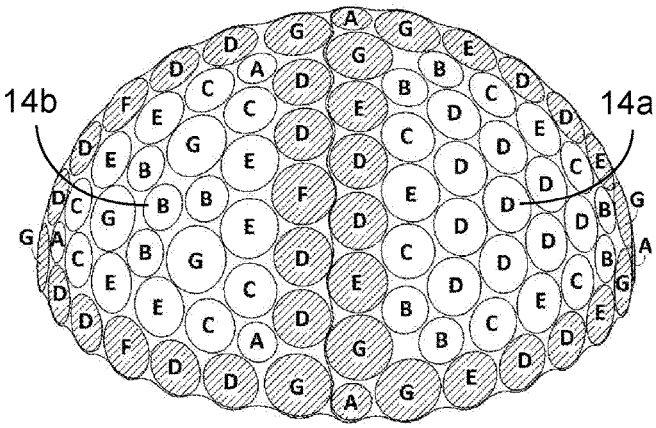
FIG. 18C illustrates a portion of a golf ball according to an embodiment of the present invention.

FIG. 18A shows a first domain 14*a* packed with dimples and a portion of a second domain 14*b*. FIG. 18B shows the second domain 14*b* packed with dimples and a portion of the first domain 14*a*. FIG. 18C shows the first and second domains packed with dimples according to the embodiments shown in FIGS. 18A and 18B.

Figure 19A:
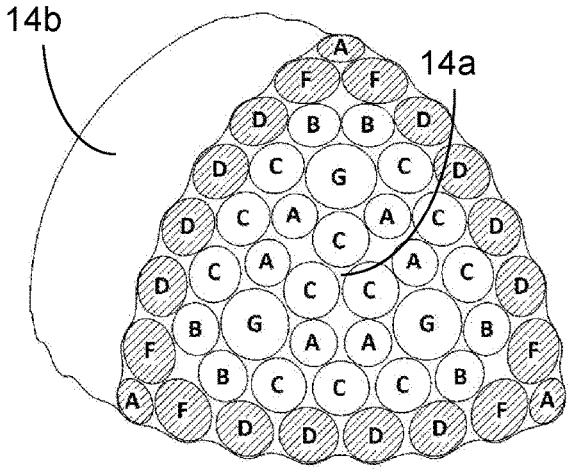
FIG. 19A illustrates a first domain with dimples and a portion of a second domain according to an embodiment of the present invention.
Figure 19B:
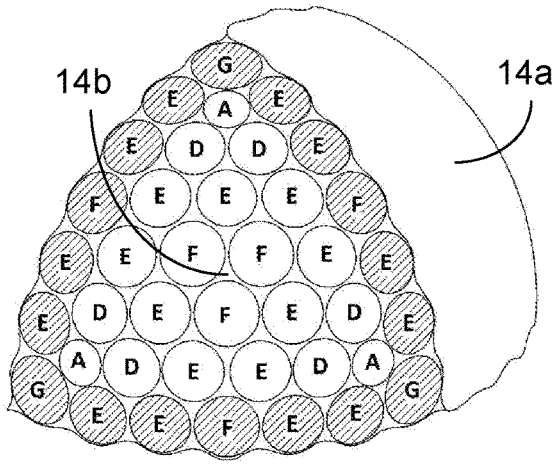
FIG. 19B illustrates a second domain with dimples and a portion of a first domain according to an embodiment of the present invention.
Figure 19C:
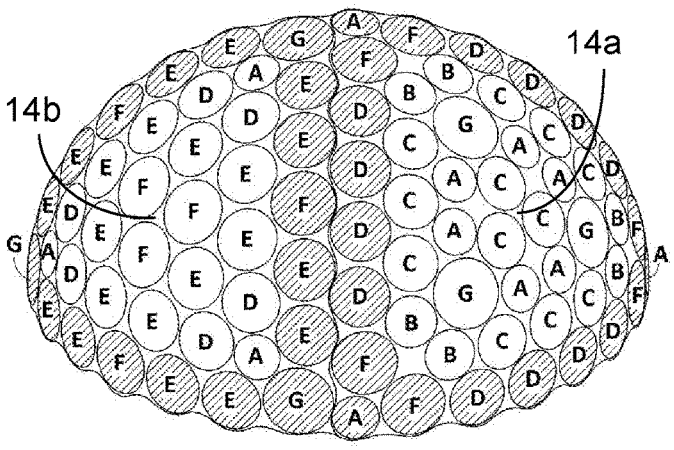
FIG. 19C illustrates a portion of a golf ball according to an embodiment of the present invention.

FIG. 19A shows a first domain 14*a* packed with dimples and a portion of a second domain 14*b*. FIG. 19B shows the second domain 14*b* packed with dimples and a portion of the first domain 14*a*. FIG. 19C shows the first and second domains packed with dimples according to the embodiments shown in FIGS. 19A and 19B.

In a particular embodiment, as illustrated in FIGS. 11E-11P, 11R-11X, 14A-14C, 15A-15C, 16A-16C, 17A-17C, 18A-18C, and 19A-19C, the dimple pattern of the first domain has three-way rotational symmetry about the central point of the first domain, and the dimple pattern of the second domain has three-way rotational symmetry about the central point of the second domain.

In one embodiment, there are no limitations on how the dimples are packed. In another embodiment, the dimples are packed such that no dimple intersects a line segment. In the embodiments shown in FIGS. 11E-11P, 11R-11X, 14A-14C, 15A-15C, 16A-16C, 17A-17C, 18A-18C, and 19A-19C, the dimples are packed within the first domain in a different pattern from that of the second domain.

Figure 12A:
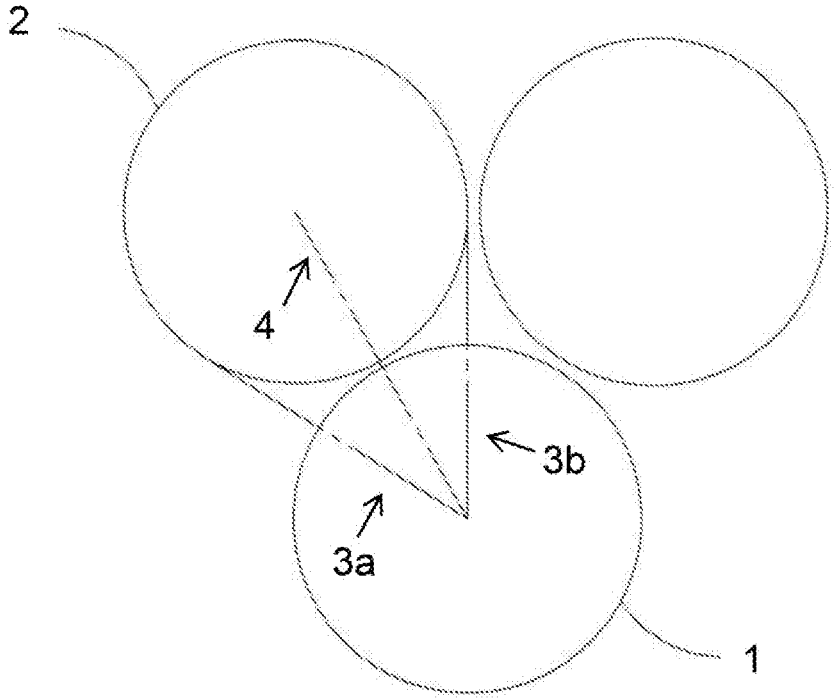
FIGS. 12A and 12B illustrate a method for determining nearest neighbor dimples.
Figure 12B:
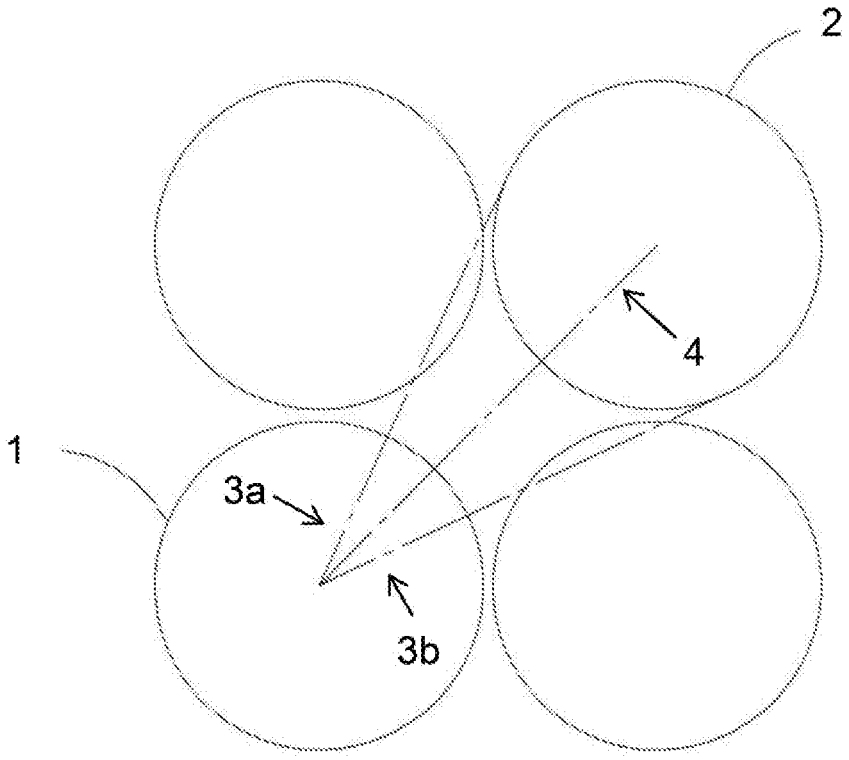

In a particular embodiment, the dimples are packed such that all nearest neighbor dimples are separated by substantially the same distance, δ, wherein the average of all δ values is from 0.002 inches to 0.020 inches, and wherein any individual δ value can vary from the mean by ±0.005 inches. For purposes of the present invention, nearest neighbor dimples are determined according to the following method. A reference dimple and a potential nearest neighbor dimple are selected such that the reference dimple has substantially the same diameter or a smaller diameter than the potential nearest neighbor dimple. Two tangency lines are drawn from the center of the reference dimple to the potential nearest neighbor dimple. A line segment is then drawn connecting the center of the reference dimple to the center of the potential nearest neighbor dimple. If the two tangency lines and the line segment do not intersect any other dimple edges, then those dimples are considered to be nearest neighbors. For example, as shown in FIG. 12A, two tangency lines 3A and 3B are drawn from the center of a reference dimple 1 to a potential nearest neighbor dimple 2. Line segment 4 is then drawn connecting the center of reference dimple 1 to the center of potential nearest neighbor dimple 2. Tangency lines 3A and 3B and line segment 4 do not intersect any other dimple edges, so dimple 1 and dimple 2 are considered nearest neighbors. In FIG. 12B, two tangency lines 3A and 3B are drawn from the center of a reference dimple 1 to a potential nearest neighbor dimple 2. Line segment 4 is then drawn connecting the center of reference dimple 1 to the center of potential nearest neighbor dimple 2. Tangency lines 3A and 3B intersect an alternative dimple, so dimple 1 and dimple 2 are not considered nearest neighbors. Those skilled in the art will recognize that the line segments do not actually have to be drawn on the golf ball. Rather, a computer modeling program capable of performing this operation automatically is preferably used.

Figure 13:
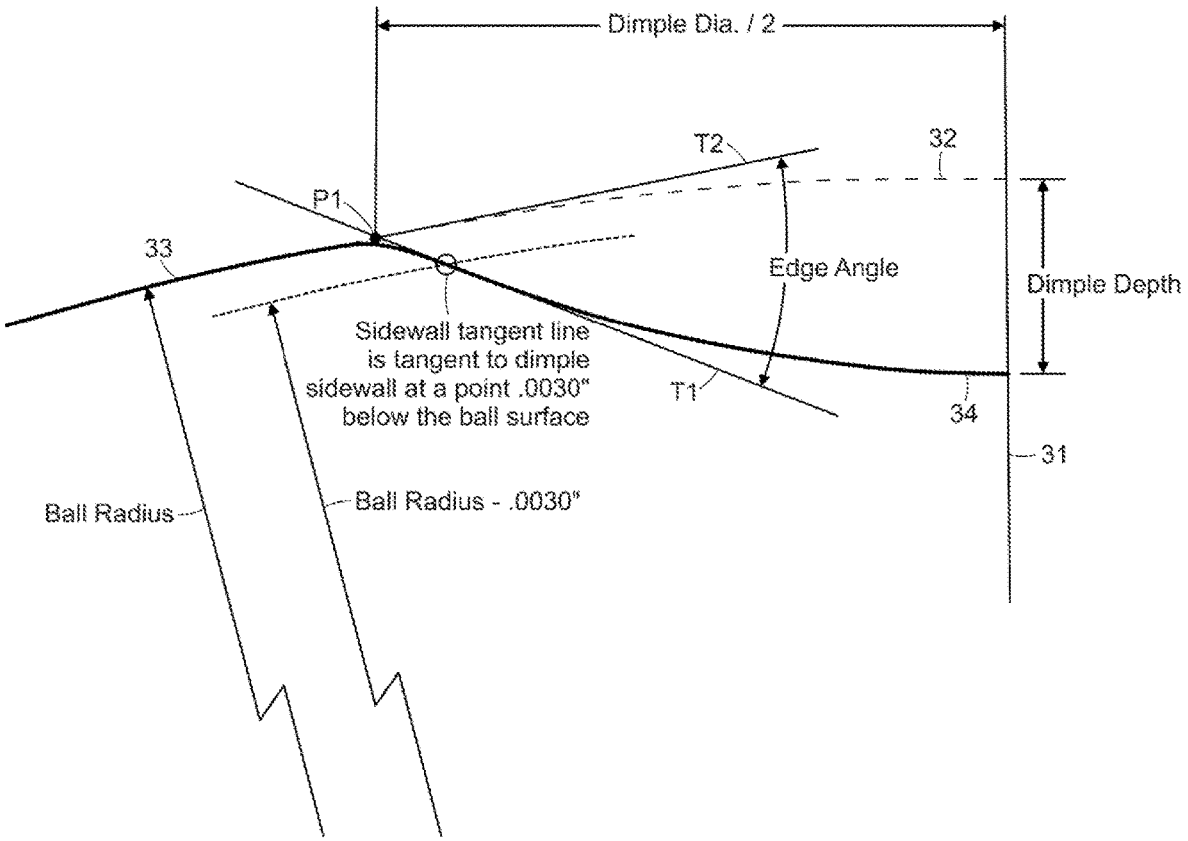
FIG. 13 is a schematic diagram illustrating a method for measuring the diameter of a dimple.

Each dimple typically has a diameter of 0.050 or 0.100 or 0.150 or 0.180 or 0.200 or 0.250 or 0.300 or 0.350 inches, or a diameter within a range having a lower limit and an upper limit selected from these values. The diameter of a dimple having a non-circular plan shape is defined by its equivalent diameter, $d_e$, which calculated as:

$$d_e = 2\sqrt{\frac{A}{\pi}}$$

where A is the plan shape area of the dimple. Diameter measurements are determined on finished golf balls according to FIG. 13. Generally, it may be difficult to measure a dimple's diameter due to the indistinct nature of the boundary dividing the dimple from the ball's undisturbed land surface. Due to the effect of paint and/or the dimple design itself, the junction between the land surface and dimple may not be a sharp corner and is therefore indistinct. This can make the measurement of a dimple's diameter somewhat ambiguous. To resolve this problem, dimple diameter on a finished golf ball is measured according to the method shown in FIG. 13. FIG. 13 shows a dimple half-profile 34, extending from the dimple centerline 31 to the land surface outside of the dimple 33. A ball phantom surface 32 is constructed above the dimple as a continuation of the land surface 33. A first tangent line T1 is then constructed at a point on the dimple sidewall that is spaced 0.003 inches radially inward from the phantom surface 32. T1 intersects phantom surface 32 at a point P1, which defines a nominal dimple edge position. A second tangent line T2 is then constructed, tangent to the phantom surface 32, at P1. The edge angle is the angle between T1 and T2. The dimple diameter is the distance between P1 and its equivalent point diametrically opposite along the dimple perimeter. Alternatively, it is twice the distance between P1 and the dimple centerline 31, measured in a direction perpendicular to centerline 31. The dimple depth is the distance measured along a ball radius from the phantom surface of the ball to the deepest point on the dimple. The dimple volume is the space enclosed between the phantom surface 32 and the dimple surface 34 (extended along T1 until it intersects the phantom surface).

In a particular embodiment, all of the dimples on the outer surface of the ball have the same diameter. It should be understood that "same diameter" dimples includes dimples on a finished ball having respective diameters that differ by less than 0.005 inches due to manufacturing variances.

In another particular embodiment, there are two or more different dimple diameters on the outer surface of the ball, including a maximum dimple diameter and a minimum dimple diameter. In a particular aspect of this embodiment, the dimples are arranged in multiple copies of a first domain and a second domain formed according to the midpoint to midpoint method based on a tetrahedron wherein the first domain and the second domain are tessellated to cover the outer surface of the golf ball in a uniform pattern having no great circles. The overall dimple pattern consists of four first domains and four second domains. The dimple pattern within the first domain is different from the dimple pattern within the second domain. Each of the first domain and the second domain consist of perimeter dimples and interior dimples.

In a first further particular aspect of this embodiment, the perimeter dimples of the first domain consist of dimples having no more than two different diameters, the perimeter dimples of the second domain consist of dimples having at least two different diameters, and the diameter of at least one perimeter dimple is the maximum dimple diameter. The dimples optionally have one or more of the following additional characteristics:

a) the diameter of at least one perimeter dimple of the first domain is the maximum dimple diameter;
b) the diameter of at least one perimeter dimples of the second domain is the maximum dimple diameter;
c) the diameter of at least one interior dimple is the maximum dimple diameter;
d) the diameter of at least one interior dimple of the first domain is the maximum dimple diameter;
e) the diameter of at least one interior dimple of the second domain is the maximum dimple diameter;
f) the diameter of at least one dimple in the first domain is the minimum dimple diameter;
g) none of the perimeter dimples of the first domain have a diameter that is the minimum dimple diameter;
h) the diameter of at least one of the perimeter dimples of the first domain is the minimum dimple diameter;
i) none of the interior dimples of the first domain have a diameter that is the minimum dimple diameter;
j) the diameter of at least one of the interior dimples of the first domain is the minimum dimple diameter;
k) the diameter of at least one dimple in the second domain is the minimum dimple diameter;
l) none of the perimeter dimples of the second domain have a diameter that is the minimum dimple diameter;
m) the diameter of at least one perimeter dimple of the second domain is the minimum dimple diameter;
n) none of the interior dimples of the second domain have a diameter that is the minimum dimple diameter;
o) the diameter of at least one interior dimple of the second domain is the minimum dimple diameter;
p) there are 3 or more different dimple diameters on the outer surface of the ball;
q) there are 4 or more different dimple diameters on the outer surface of the ball;
r) there are 5 or more different dimple diameters on the outer surface of the ball;
s) the perimeter dimples of the second domain consist of dimples having at least three different diameters;
t) the interior dimples of the first domain consist of dimples having at least three different diameters;
u) the interior dimples of the second domain consist of dimples having no more than two different diameters;
v) the interior dimples of the second domain consist of dimples having at least three different diameters; and
w) the number of different dimple diameters, D, on the outer surface is related to the total number of dimples, N, on the outer surface according to one of the particular embodiments further disclosed below.

In a second further particular aspect of this embodiment, the interior dimples of the first domain consist of dimples having at least three different diameters, the interior dimples of the second domain consist of dimples having no more than two different diameters, and the diameter of at least one dimple in the first domain is the minimum dimple diameter and the diameter of at least one dimple in the second domain is the minimum dimple diameter. The dimples optionally have one or more of the following additional characteristics:

a) there are 4 or more different dimple diameters on the outer surface of the ball;
b) there are 5 or more different dimple diameters on the outer surface of the ball;
c) none of the perimeter dimples of the first domain have a diameter that is the minimum dimple diameter;
d) the diameter of at least one of the perimeter dimples of the first domain is the minimum dimple diameter;
e) none of the interior dimples of the first domain have a diameter that is the minimum dimple diameter;
f) the diameter of at least one of the interior dimples of the first domain is the minimum dimple diameter;
g) none of the perimeter dimples of the second domain have a diameter that is the minimum dimple diameter;
h) the diameter of at least one perimeter dimple of the second domain is the minimum dimple diameter;
i) none of the interior dimples of the second domain have a diameter that is the minimum dimple diameter;
j) the diameter of at least one interior dimple of the second domain is the minimum dimple diameter;
k) the diameter of at least one interior dimple is the maximum dimple diameter;
l) the diameter of at least one interior dimple of the first domain is the maximum dimple diameter;
m) the diameter of at least one interior dimple of the second domain is the maximum dimple diameter; and
n) the perimeter dimples of the second domain consist of dimples having at least three different diameters.

In a third further particular aspect of this embodiment, none of the perimeter dimples of the first domain have a diameter that is the maximum or the minimum dimple diameter, the diameter of at least one of the perimeter dimples of the second domain is the maximum dimple diameter, and the diameter of at least one of the perimeter dimples of the second domain is the minimum dimple diameter.

In a fourth further particular aspect of this embodiment, the perimeter dimples within each domain have a particular diameter relationship as follows. As stated above, in the present embodiment, the domains are generated using the midpoint to midpoint method based on a tetrahedron. Thus, as illustrated, for example, in FIGS. 11A-11D, each first domain 14*a* and second domain 14*b* is defined by three irregular segments, i.e., an irregular segment 18 and two copies thereof. The three irregular segments of a given domain are connected at their endpoints which correspond to the midpoints of the edges of the faces of the base tetrahedron used to generate the domains, for example, $M_1$ and $M_2$ in FIGS. 11A-11C. The perimeter dimples of a given domain are positioned adjacent to the three irregular segments defining that domain. Each perimeter dimple is positioned adjacent to a single irregular segment, except in the case where a domain has one perimeter dimple located at each of its vertices, in which case the perimeter dimple located at each vertex is adjacent to two irregular segments. Domains having a single perimeter dimple located at the vertices of the domain are illustrated, for example, as domain 14*a* of FIGS. 11E, 11H, 11K, 11N, 11R, 11S and 11V, and domain 14*b* of FIG. 11O.

For each one of the three irregular segments defining a domain, a reference line is drawn connecting the endpoints of the irregular segment in the plane that is normal to the axis of symmetry of that domain. For example, FIG. 11Q shows a first domain 14*a* defined by three irregular segments, a portion of a second domain 14*b* defined by three irregular segments, and one of the three reference lines that can be drawn connecting two endpoints of the irregular segments. FIG. 11R shows the perimeter dimples of the first domain 14*a*, the perimeter dimples of a portion of the second domain 14*b*, and the reference line shown in FIG. 11Q. In FIG. 11R, all of the perimeter dimples positioned adjacent to a common irregular segment of the first domain 14*a* are intersected by the reference line connecting the endpoints of the common irregular segment; however, in some embodiments, a portion of the perimeter dimples positioned adjacent to a common irregular segment of a given domain are not intersected by the reference line connecting the endpoints of the common irregular segment.

In this particular embodiment, all of the perimeter dimples within a domain that are positioned adjacent to a common irregular segment have a diameter relationship wherein their respective diameters get progressively smaller (or, alternatively, progressively larger) as the distance gets larger from each dimple's centroid to the midpoint of the reference line connecting the endpoints of the common irregular segment.

For example, FIGS. 11S-11U, discussed further below, illustrate an embodiment wherein all of the perimeter dimples within a given domain that are positioned adjacent to a common irregular segment defining that domain have a diameter relationship wherein their respective diameters get progressively smaller as the distance from each dimple's centroid to the midpoint of the reference line connecting the endpoints of the common irregular segment gets larger. In other words, all of the perimeter dimples within a given domain have a diameter relationship wherein $$\text{if } x_{dimple\ 1} > x_{dimple\ 2}, \text{ then } d_{dimple\ 1} < d_{dimple\ 2},$$

where dimple 1 and dimple 2 are any two perimeter dimples of the given domain positioned adjacent to a common irregular segment defining the given domain, d is the dimple diameter, and x is the distance from the center of the dimple to the midpoint of a reference line connecting the endpoints of the common irregular segment.

Alternatively, FIGS. 11V-11X, discussed further below, illustrate an embodiment wherein all of the perimeter dimples within a given domain that are positioned adjacent to a common irregular segment defining that domain have a diameter relationship wherein their respective diameters get progressively larger as the distance from each dimple's centroid to the midpoint of the reference line connecting the endpoints of the common irregular segment gets larger. In other words, all of the perimeter dimples within a given domain have a diameter relationship wherein $$\text{if } x_{dimple\ 1} > x_{dimple\ 2}, \text{ then } d_{dimple\ 1} > d_{dimple\ 2},$$

where dimple 1 and dimple 2 are any two perimeter dimples of the given domain positioned adjacent to a common irregular segment defining the given domain, d is the dimple diameter, and x is the distance from the center of the dimple to the midpoint of a reference line connecting the endpoints of the common irregular segment.

Referring now to FIGS. 11S-11U, only the perimeter dimples are shown. The interior dimples are positioned within each domain in any suitable pattern that has three-way rotational symmetry about the central point of the domain. The alphabetic labels within the dimples designate same diameter dimples. For example, all dimples labelled A have the same diameter, all dimples labelled B have the same diameter, and so on. In a particular aspect of the embodiment illustrated in FIGS. 11S-11U, the dimples labelled A have a diameter of about 0.130 inches, the dimples labelled B have a diameter of about 0.150 inches, the dimples labelled C have a diameter of about 0.165 inches, and the dimples labelled D have a diameter of about 0.175 inches.

In FIG. 11S, for the perimeter dimples positioned adjacent to a common irregular segment defining the first domain 14*a*, the dimples labelled D have the largest diameter and are positioned closest to the midpoint of the reference line connecting the endpoints of the common irregular segment; the dimples labelled C have a smaller diameter than the dimples labelled D and are positioned second closest to the midpoint of the reference line; the dimples labelled B have a smaller diameter than the dimple labelled C and are positioned third closest to the midpoint of the reference line; and the dimples labelled A have the smallest diameter and are positioned furthest from the midpoint of the reference line. Thus, all of the perimeter dimples of the first domain have a diameter relationship wherein $$\text{if } x_{dimple\ 1} > x_{dimple\ 2}$$

$$\text{then } d_{dimple\ 1} < d_{dimple\ 2},$$

where dimple 1 and dimple 2 are any two perimeter dimples of the first domain positioned adjacent to a common irregular segment, d is the dimple diameter, and x is the distance from the center of the dimple to the midpoint of a reference line connecting the endpoints of the common irregular segment.

In FIG. 11T, for the perimeter dimples positioned adjacent to a common irregular segment defining the second domain 14*b*, the dimple labelled D has the largest diameter and is positioned closest to the midpoint of the reference line connecting the endpoints of the common irregular segment; the dimples labelled C have a smaller diameter than the dimple labelled D and are positioned second closest to the midpoint of the reference line; the dimples labelled B have a smaller diameter than the dimple labelled C and are positioned third closest to the midpoint of the reference line; and the dimples labelled A have the smallest diameter and are positioned furthest from the midpoint of the reference line. Thus, all of the perimeter dimples of the second domain have a diameter relationship wherein $$\text{if } x_{dimple\ 3} > x_{dimple\ 4}$$

$$\text{then } d_{dimple\ 3} < d_{dimple\ 4},$$

where dimple 3 and dimple 4 are any two perimeter dimples of the second domain positioned adjacent to a common irregular segment, d is the dimple diameter, and x is the distance from the center of the dimple to the midpoint of a reference line connecting the endpoints of the common irregular segment.

The embodiment shown in FIGS. 11S-11U additionally has the following characteristics:

a) the total number of perimeter dimples of the first domain, i.e., 21, is equal to the total number of perimeter dimples of the second domain, i.e. 21;
b) the number of first domain perimeter dimples adjacent to a common irregular segment defining the first domain, i.e., 8, is not equal to the number of second domain perimeter dimples adjacent to a common irregular segment defining the second domain, i.e., 7; and
c) each perimeter dimple of the first domain has substantially the same diameter as at least one of its nearest neighbor dimples located in the second domain.

Referring now to FIGS. 11V-11X, only the perimeter dimples are shown. The interior dimples are positioned within each domain in any suitable pattern that has three-way rotational symmetry about the central point of the domain. The alphabetic labels within the dimples designate same diameter dimples. For example, all dimples labelled A have the same diameter, all dimples labelled B have the same diameter, and so on. In a particular aspect of the embodiment illustrated in FIGS. 11V-11X, the dimples labelled A have a diameter of about 0.140 inches, the dimples labelled B have a diameter of about 0.150 inches, the dimples labelled C have a diameter of about 0.155 inches, the dimples labelled D have a diameter of about 0.160 inches, the dimples labelled E have a diameter of about 0.165 inches, the dimples labelled F have a diameter of about 0.170 inches, and the dimples labelled G have a diameter of about 0.180 inches.

In FIG. 11V, for the perimeter dimples positioned adjacent to a common irregular segment defining the first domain 14*a*, the dimples labelled B have the smallest diameter and are positioned closest to the midpoint of the reference line connecting the endpoints of the common irregular segment; the dimples labelled D have a larger diameter than the dimples labelled B and are positioned second closest to the midpoint of the reference line; the dimples labelled F have a larger diameter than the dimples labelled D and are positioned third closest to the midpoint of the reference line; and the dimples labelled G have the largest diameter and are positioned furthest from the midpoint of the reference line. Thus, all of the perimeter dimples of the first domain have a diameter relationship wherein $$\text{if } x_{dimple\ 1} > x_{dimple\ 2}$$

$$\text{then } d_{dimple\ 1} > d_{dimple\ 2},$$

where dimple 1 and dimple 2 are any two perimeter dimples of the first domain positioned adjacent to a common irregular segment, d is the dimple diameter, and x is the distance from the center of the dimple to the midpoint of a reference line connecting the endpoints of the common irregular segment.

In FIG. 11W, for the perimeter dimples positioned adjacent to a common irregular segment defining the second domain 14*b*, the dimple labelled A has the smallest diameter and is positioned closest to the midpoint of the reference line connecting the endpoints of the common irregular segment; the dimples labelled B have a larger diameter than the dimple labelled A and are positioned second closest to the midpoint of the reference line; the dimples labelled C have a larger diameter than the dimples labelled B and are positioned third closest to the midpoint of the reference line; and the dimples labelled E have the largest diameter and are positioned furthest from the midpoint of the reference line. Thus, all of the perimeter dimples of the second domain have a diameter relationship wherein $$\text{if } x_{dimple\ 3} > x_{dimple\ 4}$$

$$\text{then } d_{dimple\ 3} > d_{dimple\ 4},$$

where dimple 3 and dimple 4 are any two perimeter dimples of the second domain positioned adjacent to a common irregular segment, d is the dimple diameter, and x is the distance from the center of the dimple to the midpoint of a reference line connecting the endpoints of the common irregular segment.

The embodiment shown in FIGS. 11V-11X additionally has the following characteristics:

a) the total number of perimeter dimples of the first domain, i.e., 21, is equal to the total number of perimeter dimples of the second domain, i.e. 21;
b) the number of first domain perimeter dimples adjacent to a common irregular segment defining the first domain, i.e., 8, is not equal to the number of second domain perimeter dimples adjacent to a common irregular segment defining the second domain, i.e., 7; and
c) at least one perimeter dimple of the first domain has substantially the same diameter as at least one of its nearest neighbor dimples located in the second domain, i.e., the dimples labelled B.

While FIGS. 11S-11X illustrate embodiments wherein the perimeter dimples of both domains have the same diameter relationship (i.e., in both domains the diameters get progressively smaller going from the midpoint to each endpoint of the reference line, or in both domains the diameters get progressively larger going from the midpoint to each endpoint of the reference line), the present invention includes embodiments wherein the perimeter dimples of only one of the two domains have a diameter relationship wherein the diameters get progressively smaller or larger going from the midpoint to each endpoint of the reference line. The present invention also includes embodiments wherein the perimeter dimples of one domain have a diameter relationship wherein the diameters get progressively smaller and the perimeter dimples of the other domain have a diameter relationship wherein the diameters get progressively larger, going from the midpoint to each endpoint of the reference line.

In a further aspect of this particular embodiment, the dimples additionally have one or more of the following additional characteristics:

a) the total number of perimeter dimples of the first domain is not equal to the total number of perimeter dimples of the second domain;
b) the total number of perimeter dimples of the first domain is equal to the total number of perimeter dimples of the second domain;
c) at least one perimeter dimple of the first domain has substantially the same diameter as at least one of its nearest neighbor dimples located in the second domain;
d) each perimeter dimple of the first domain has substantially the same diameter as at least one of its nearest neighbor dimples located in the second domain;
e) none of the perimeter dimples of the first domain has substantially the same diameter as at least one of its nearest neighbor dimples located in the second domain;
f) the number of first domain perimeter dimples adjacent to a common irregular segment defining the first domain is not equal to the number of second domain perimeter dimples adjacent to a common irregular segment defining the second domain; and
g) the number of first domain perimeter dimples adjacent to a common irregular segment defining the first domain is equal to the number of second domain perimeter dimples adjacent to a common irregular segment defining the second domain.

For purposes of the present disclosure, each dimple on the outer surface of the golf ball is either a perimeter dimple or an interior dimple and is positioned entirely within either a first domain or a second domain. Perimeter dimples are those dimples located directly adjacent to a border segment. Interior dimples are those dimples not located directly adjacent to a border segment. Nearest neighbor dimples can also be used to determine whether a given dimple is a perimeter dimple or an interior dimple. If at least one of a particular dimple's nearest neighbor dimples is located in a different domain as that particular dimple, then that particular dimple is a perimeter dimple. If all of a particular dimple's nearest neighbor dimples are located in the same domain as that particular dimple, then that particular dimple is an interior dimple.

The perimeter dimples of a given domain are those located inside of that domain, and, in a particular embodiment, form an axially symmetric pattern about the geometric center of the domain. The interior dimples of a given domain are those located within the domain, and, in a particular embodiment, form an axially symmetric pattern about the geometric center of the domain.

For example, in the embodiments shown in FIGS. 11K, 11N, 14A, 15A, 16A, 17A, 18A, and 19A, the shaded dimples represent the perimeter dimples of the first domain 14*a*, and the unshaded dimples represent the interior dimples of the first domain 14*a*. In the embodiments shown in FIGS. 11L, 11O, 14B, 15B, 16B, 17B, 18B, and 19B, the shaded dimples represent the perimeter dimples of the second domain 14*b*, and the unshaded dimples represent the interior dimples of the second domain 14*b*. Thus, in FIGS. 11M, 11P, 14C, 15C, 16C, 17C, 18C, and 19C, which show the first domain 14*a* and the second domain 14*b* packed with dimples according to the embodiments shown in FIGS. 11K-11L, 11N-11O, 14A-14B, 15A-15B, 16A-16B, 17A-17B, 18A-18B, and 19A-19B, respectively, the shaded dimples represent the perimeter dimples and the unshaded dimples represent the interior dimples.

In FIGS. 11K-11M, the alphabetic labels within the dimples designate same diameter dimples. For example, all dimples labelled A have the same diameter, all dimples labelled B have the same diameter, and so on. In a particular aspect of the embodiment illustrated in FIGS. 11K-11M, the dimples labelled A have a diameter of about 0.130 inches, the dimples labelled B have a diameter of about 0.160 inches, the dimples labelled C have a diameter of about 0.170 inches, and the dimples labelled D have a diameter of about 0.175 inches. Thus, according to the embodiment shown in FIG. 11M, when the first domain 14*a* and the second domain 14*b* are tessellated about the outer surface of the golf ball, the resulting overall dimple pattern has a total of 352 dimples, having four different dimple diameters, including a maximum dimple diameter of 0.175 inches and a minimum dimple diameter of 0.130 inches. The embodiment shown in FIGS. 11K-11M additionally has the following characteristics:

a) the perimeter dimples of the first domain consist of dimples having two different diameters;
b) none of the perimeter dimples of the first domain have a diameter that is the maximum dimple diameter;
c) none of the perimeter dimples of the first domain have a diameter that is the minimum dimple diameter;
d) the perimeter dimples of the second domain consist of dimples having three different diameters;
e) the diameter of at least one perimeter dimple of the second domain is the maximum dimple diameter;
f) the diameter of at least one perimeter dimple of the second domain is the minimum dimple diameter;
g) the interior dimples of the first domain consist of dimples having three different diameters;
h) the diameter of at least one interior dimple of the first domain is the maximum dimple diameter;
i) the diameter of at least one of the interior dimples of the first domain is the minimum dimple diameter;
j) the interior dimples of the second domain consist of dimples having two different diameters;
k) the diameter of at least one interior dimple of the second domain is the maximum dimple diameter; and
l) none of the interior dimples of the second domain have a diameter that is the minimum dimple diameter.

In FIGS. 11N-11P, the alphabetic labels within the dimples designate same diameter dimples. For example, all dimples labelled A have the same diameter, all dimples labelled B have the same diameter, and so on. In a particular aspect of the embodiment illustrated in FIGS. 11N-11P, the dimples labelled A have a diameter of about 0.125 inches, the dimples labelled B have a diameter of about 0.148 inches, the dimples labelled C have a diameter of about 0.166 inches, the dimples labelled D have a diameter of about 0.176 inches, and the dimples labelled E have a diameter of about 0.198 inches. Thus, according to the embodiment shown in FIG. 11P, when the first domain 14*a* and the second domain 14*b* are tessellated about the outer surface of the golf ball, the resulting overall dimple pattern has a total of 328 dimples, having five different dimple diameters, including a maximum dimple diameter of 0.198 inches and a minimum dimple diameter of 0.125 inches. The embodiment shown in FIGS. 11N-11P additionally has the following characteristics:

a) the perimeter dimples of the first domain consist of dimples having two different diameters;
b) the diameter of at least one perimeter dimple of the first domain is the maximum dimple diameter;
c) none of the perimeter dimples of the first domain have a diameter that is the minimum dimple diameter;
d) the perimeter dimples of the second domain consist of dimples having three different diameters;
e) none of the perimeter dimples of the second domain have a diameter that is the maximum dimple diameter;
f) the diameter of at least one perimeter dimple of the second domain is the minimum dimple diameter;
the interior dimples of the first domain consist of dimples having three different diameters;
h) none of the interior dimples of the first domain have a diameter that is the maximum dimple diameter;
i) the diameter of at least one of the interior dimples of the first domain is the minimum dimple diameter;
j) the interior dimples of the second domain consist of dimples having four different diameters;
k) the diameter of at least one interior dimple of the second domain is the maximum dimple diameter; and
l) the diameter of at least one interior dimple of the second domain is the minimum dimple diameter.

In FIGS. 14A-14C, the alphabetic labels within the dimples designate same diameter dimples. For example, all dimples labelled A have the same diameter, all dimples labelled B have the same diameter, and so on. In a particular aspect of the embodiment illustrated in FIGS. 14A-14C, the dimples labelled A have a diameter of about 0.180 inches, the dimples labelled B have a diameter of about 0.200 inches, the dimples labelled C have a diameter of about 0.250 inches, the dimples labelled D have a diameter of about 0.280 inches, and the dimples labelled E have a diameter of about 0.300 inches. Thus, according to the embodiment shown in FIG. 14C, when the first domain 14*a* and the second domain 14*b* are tessellated about the outer surface of the golf ball, the resulting overall dimple pattern has a total of 148 dimples, having five different dimple diameters, including a maximum dimple diameter of 0.300 inches and a minimum dimple diameter of 0.180 inches. The embodiment shown in FIGS. 14A-14C additionally has the following characteristics:

a) none of the perimeter dimples of the first domain has the same dimple diameter as a perimeter dimple of the second domain;
b) none of the interior dimples of the first domain has the same dimple diameter as an interior dimple of the second domain;
c) at least one of the interior dimples of the first domain has the same dimple diameter as a perimeter dimple of the second domain;
d) at least one of the interior dimples of the second domain has the same dimple diameter as a perimeter dimple of the first domain;
e) the plurality of dimples comprises dimples having at least two different diameters including a maximum dimple diameter and a minimum dimple diameter, and none of the dimples located within the second domain has the maximum dimple diameter;
f) the plurality of dimples comprises dimples having at least two different diameters including a maximum dimple diameter and a minimum dimple diameter, and none of the dimples located within the second domain has the minimum dimple diameter;
g) the plurality of dimples comprises dimples having at least two different diameters including a maximum dimple diameter and a minimum dimple diameter, none of the dimples located within the second domain has the maximum dimple diameter, and wherein none of the dimples located within the second domain has the minimum dimple diameter;
h) the combined total number of perimeter dimples of the first domain and perimeter dimples of the second domain is greater than the combined total number of interior dimples of the first domain and interior dimples of the second domain;
i) the combined total number of perimeter dimples of the first domain and perimeter dimples of the second domain is less than 25:
j) the total number of dimples located within the first domain is less than 20; and
k) the total number of dimples located within the second domain is less than 20.

In FIGS. 15A-15C, the alphabetic labels within the dimples designate same diameter dimples. For example, all dimples labelled A have the same diameter, all dimples labelled B have the same diameter, and so on. In a particular aspect of the embodiment illustrated in FIGS. 15A-15C, the dimples labelled A have a diameter of about 0.128 inches, the dimples labelled B have a diameter of about 0.148 inches, the dimples labelled C have a diameter of about 0.158 inches, the dimples labelled D have a diameter of about 0.168 inches, and the dimples labelled E have a diameter of about 0.173 inches. Thus, according to the embodiment shown in FIG. 15C, when the first domain 14*a* and the second domain 14*b* are tessellated about the outer surface of the golf ball, the resulting overall dimple pattern has a total of 376 dimples, having five different dimple diameters, including a maximum dimple diameter of 0.173 inches and a minimum dimple diameter of 0.128 inches. The embodiment shown in FIGS. 15A-15C additionally has the following characteristics:

a) the perimeter dimples of the first domain include dimples having three different diameters;
b) the interior dimples of the first domain include dimples having four different diameters;
c) the perimeter dimples of the second domain include dimples having four different diameters;
d) the interior dimples of the second domain include dimples having four different diameters;
e) each of the perimeter dimples of the second domain has the same diameter as at least one interior dimple of the second domain;
f) each of the interior dimples of the second domain has the same diameter as at least one perimeter dimple of the second domain;
g) at least one of the perimeter dimples of the first domain has a diameter that is not the same as any interior dimple of the first domain;
h) at least one of the interior dimples of the first domain has a diameter that is not the same as any perimeter dimple of the first domain;
i) the plurality of dimples comprises dimples having at least four different diameters including a maximum diameter, a minimum diameter, a first additional diameter, and a second additional diameter; and at least one of the dimples located within the second domain has the maximum diameter;
j) the plurality of dimples comprises dimples having at least four different diameters including a maximum diameter, a minimum diameter, a first additional diameter, and a second additional diameter; and none of the dimples located within the second domain has the minimum diameter;
k) the plurality of dimples comprises dimples having at least four different diameters including a maximum diameter, a minimum diameter, a first additional diameter, and a second additional diameter; and at least one of the dimples located within the first domain has the maximum diameter;
l) the plurality of dimples comprises dimples having at least four different diameters including a maximum diameter, a minimum diameter, a first additional diameter, and a second additional diameter; and at least one of the dimples located within the first domain has the minimum diameter;
m) the plurality of dimples comprises dimples having at least four different diameters including a maximum diameter, a minimum diameter, a first additional diameter, and a second additional diameter; at least one of the perimeter dimples of the first domain has the minimum diameter, and at least one of the interior dimples of the first domain has the minimum diameter;
n) the plurality of dimples comprises dimples having at least four different diameters including a maximum diameter, a minimum diameter, a first additional diameter, and a second additional diameter; and at least one of the interior dimples of the first domain has the maximum diameter;
o) the plurality of dimples comprises dimples having at least four different diameters including a maximum diameter, a minimum diameter, a first additional diameter, and a second additional diameter; and none of the perimeter dimples of the first domain has the maximum diameter;
p) the plurality of dimples comprises dimples having five different diameters;
q) the maximum diameter is from 0.155 inches to 0.180 inches; and
r) the minimum diameter is from 0.110 inches to 0.135 inches.

In FIGS. 16A-16C, the alphabetic labels within the dimples designate same diameter dimples. For example, all dimples labelled A have the same diameter, all dimples labelled B have the same diameter, and so on. In a particular aspect of the embodiment illustrated in FIGS. 16A-16C, the dimples labelled A have a diameter of about 0.130 inches, the dimples labelled B have a diameter of about 0.140 inches, the dimples labelled C have a diameter of about 0.150 inches, the dimples labelled D have a diameter of about 0.158 inches, and the dimples labelled E have a diameter of about 0.175 inches. Thus, according to the embodiment shown in FIG. 16C, when the first domain 14*a* and the second domain 14*b* are tessellated about the outer surface of the golf ball, the resulting overall dimple pattern has a total of 388 dimples, having five different dimple diameters, including a maximum dimple diameter of 0.175 inches and a minimum dimple diameter of 0.130 inches. The embodiment shown in FIGS. 16A-16C additionally has the following characteristics:

a) none of the perimeter dimples of either domain has the minimum diameter;
b) at least one of the interior dimples of the first domain has the minimum diameter, and at least one of the interior dimples of the second domain has the minimum diameter;
c) at least one of the interior dimples of the first domain has the maximum diameter;
d) none of the perimeter dimples of the first domain has the maximum diameter;
e) at least one of the perimeter dimples of the second domain has the maximum diameter;
f) none of the interior dimples of the second domain has the maximum diameter;
g) each of the perimeter dimples of the second domain has the same diameter as at least one interior dimple of the first domain;
h) the difference in diameter between any two perimeter dimples of the first domain does not exceed 0.030 inches;
i) the difference in diameter between any two perimeter dimples of the first domain does not exceed 0.020 inches;
j) the difference in diameter between any two perimeter dimples of the second domain does not exceed 0.030 inches;
k) the difference in diameter between any two perimeter dimples of the second domain does not exceed 0.025 inches;
l) the maximum diameter is from 0.170 inches to 0.180 inches; and
m) the minimum diameter is from 0.125 inches to 0.135 inches.

In FIGS. 17A-17C, the alphabetic labels within the dimples designate same diameter dimples. For example, all dimples labelled A have the same diameter, all dimples labelled B have the same diameter, and so on. In a particular aspect of the embodiment illustrated in FIGS. 17A-17C, the dimples labelled A have a diameter of about 0.110 inches, the dimples labelled B have a diameter of about 0.135 inches, the dimples labelled C have a diameter of about 0.140 inches, the dimples labelled D have a diameter of about 0.150 inches, the dimples labelled E have a diameter of about 0.155 inches, the dimples labelled F have a diameter of about 0.160 inches, the dimples labelled G have a diameter of about 0.165 inches, the dimples labelled H have a diameter of about 0.180 inches, and the dimples labelled I have a diameter of about 0.190 inches. Thus, according to the embodiment shown in FIG. 17C, when the first domain 14*a* and the second domain 14*b* are tessellated about the outer surface of the golf ball, the resulting overall dimple pattern has a total of 388 dimples, having nine different dimple diameters, including a maximum dimple diameter of 0.190 inches and a minimum dimple diameter of 0.110 inches. The embodiment shown in FIGS. 17A-17C additionally has the following characteristics:

a) none of the perimeter dimples of either domain has the minimum diameter;
b) none of the perimeter dimples of either domain has the maximum diameter;
c) at least one of the interior dimples of the first domain has the minimum diameter;
d) at least one of the interior dimples of the first domain has the maximum diameter;
e) none of the interior dimples of the second domain has the minimum diameter;
f) none of the interior dimples of the second domain has the maximum diameter;
g) the difference in diameter between any two perimeter dimples of the first domain does not exceed 0.030 inches;
h) the difference in diameter between any two perimeter dimples of the first domain does not exceed 0.020 inches;
i) the difference in diameter between any two perimeter dimples of the second domain does not exceed 0.030 inches;
j) the difference in diameter between any two perimeter dimples of the second domain does not exceed 0.025 inches;
k) the maximum diameter is from 0.185 inches to 0.195 inches; and
l) the minimum diameter is from 0.105 inches to 0.115 inches.

In another particular embodiment, there are four or more different dimple diameters on the outer surface of the ball, including a minimum dimple diameter, a maximum dimple diameter, and at least two additional dimple diameters. The dimples are arranged in multiple copies of a first domain and a second domain formed according to the midpoint to midpoint method based on a tetrahedron wherein the first domain and the second domain are tessellated to cover the outer surface of the golf ball in a uniform pattern having no great circles. The first domain is defined by three irregular segments and has three-way rotational symmetry about the central point of the first domain, and the second domain is defined by three irregular segments and has three-way rotational symmetry about the central point of the second domain. The overall dimple pattern consists of four first domains and four second domains. The dimple pattern within the first domain is different from the dimple pattern within the second domain. Each of the first domain and the second domain consist of perimeter dimples and interior dimples. The perimeter dimples of the first domain include from one to ten dimples having the maximum dimple diameter. The perimeter dimples of the second domain include from one to ten dimples having the maximum dimple diameter.

For example, FIGS. 18A-18C illustrate a first domain 14*a* and a second domain 14*b* formed according to the midpoint to midpoint method based on a tetrahedron. The shaded dimples represent perimeter dimples. The unshaded dimples represent interior dimples. The alphabetical labels within the dimples designate same diameter dimples; i.e., all dimples labelled A have the same diameter, all dimples labelled B have the same diameter, and so on. For each group of same diameter dimples, Table 10 below indicates the number of perimeter dimples positioned in the first domain, the number of interior dimples positioned in the first domain, the number of perimeter dimples positioned in the second domain, and the number of interior dimples positioned in the second domain. In a particular aspect of the embodiment illustrated in FIGS. 18A-18C, the dimples have the diameters given in Table 10 below.

TABLE 10

| Dimple Diameter (alphabetical label) | Dimple Diameter (inches) | Perimeter Dimples First Domain (#) | Interior Dimples First Domain (#) | Perimeter Dimples Second Domain (#) | Interior Dimples Second Domain (#) |
|---|---|---|---|---|---|
| A | 0.116 | 3 | 0 | 0 | 3 |
| B | 0.136 | 0 | 6 | 0 | 4 |
| C | 0.156 | 0 | 6 | 0 | 6 |
| D | 0.166 | 6 | 10 | 12 | 0 |
| E | 0.171 | 6 | 3 | 0 | 6 |
| F | 0.181 | 0 | 0 | 3 | 0 |
| G | 0.191 | 6 | 0 | 3 | 3 |

Thus, according to the embodiment shown in FIGS. 18A-18C, tessellating first domain 14*a* and second domain 14*b* about the outer surface of a golf ball results in an overall dimple pattern having a total of 344 dimples arranged within four copies of first domain 14*a* and four copies of second domain 14*b*, the dimples having seven different dimple diameters. In a particular aspect of the embodiment shown in FIGS. 18A-18C, the total number of dimples in the first domain having the maximum dimple diameter is equal to the total number of dimples in the second domain having the maximum dimple diameter. In another particular aspect of the embodiment shown in FIGS. 18A-18C, the total number of dimples located in the first domain having the minimum dimple diameter is equal to the number of dimples located in the second domain having the minimum dimple diameter.

In another particular embodiment, there are five or more different dimple diameters on the outer surface of the ball, including a minimum dimple diameter, a maximum dimple diameter, and at least three additional dimple diameters. The dimples are arranged in multiple copies of a first domain and a second domain formed according to the midpoint to midpoint method based on a tetrahedron wherein the first domain and the second domain are tessellated to cover the outer surface of the golf ball in a uniform pattern having no great circles. The first domain is defined by three irregular segments and has three-way rotational symmetry about the central point of the first domain, and the second domain is defined by three irregular segments and has three-way rotational symmetry about the central point of the second domain. The overall dimple pattern consists of four first domains and four second domains. The dimple pattern within the first domain is different from the dimple pattern within the second domain. Each of the first domain and the second domain consist of perimeter dimples and interior dimples. The perimeter dimples of the first domain include at least one dimple having the minimum dimple diameter. The interior dimples of the first domain include at least one dimple having the minimum dimple diameter. The number of interior dimples of the first domain having the minimum dimple diameter is at least two times the number of perimeter dimples of the first domain having the minimum dimple diameter.

For example, FIGS. 19A-19C illustrate a first domain 14*a* and a second domain 14*b* formed according to the midpoint to midpoint method based on a tetrahedron. The shaded dimples represent perimeter dimples. The unshaded dimples represent interior dimples. The alphabetical labels within the dimples designate same diameter dimples; i.e., all dimples labelled A have the same diameter, all dimples labelled B have the same diameter, and so on. For each group of same diameter dimples, Table 11 below indicates the number of perimeter dimples positioned in the first domain, the number of interior dimples positioned in the first domain, the number of perimeter dimples positioned in the second domain, and the number of interior dimples positioned in the second domain. In a particular aspect of the embodiment illustrated in FIGS. 19A-19C, the dimples have the diameters given in Table 11 below.

TABLE 11

| Dimple Diameter (alphabetical label) | Dimple Diameter (inches) | Perimeter Dimples First Domain (#) | Interior Dimples First Domain (#) | Perimeter Dimples Second Domain (#) | Interior Dimples Second Domain (#) |
|---|---|---|---|---|---|
| A | 0.128 | 3 | 6 | 0 | 3 |
| B | 0.143 | 0 | 6 | 0 | 0 |
| C | 0.153 | 0 | 12 | 0 | 0 |
| D | 0.163 | 12 | 0 | 0 | 6 |
| E | 0.168 | 0 | 0 | 12 | 9 |
| F | 0.178 | 6 | 0 | 3 | 3 |
| G | 0.193 | 0 | 3 | 3 | 0 |

Thus, according to the embodiment shown in FIGS. 19A-19C, tessellating first domain 14*a* and second domain 14*b* about the outer surface of a golf ball results in an overall dimple pattern having a total of 348 dimples arranged within four copies of first domain 14*a* and four copies of second domain 14*b*, the dimples having seven different dimple diameters. In a particular aspect of the embodiment shown in FIGS. 19A-19C, the number of interior dimples of the first domain having the minimum dimple diameter is at least two times the number of perimeter dimples of the first domain having the minimum dimple diameter. In another particular aspect of the embodiment shown in FIGS. 19A-19C, the total number of dimples in the first domain having the maximum dimple diameter is equal to the total number of dimples in the second domain having the maximum dimple diameter.

In a particular aspect of the embodiments disclosed herein wherein there are two or more different dimple diameters on the outer surface of the ball, the number of different dimple diameters, D, on the outer surface is related to the total number of dimples, N, on the outer surface, such that if:

$N<312$, then $D\leq 5$;

$N=312$, then $D\leq 4$;

$312<N<328$, then $D\leq 5$;

$N=328$, then $D\leq 6$;

$328<N<352$, then $D\leq 5$;

$N=352$, then $D\leq 4$;

$352<N<376$, then $D\leq 5$;

$N=376$, then $D\leq 7$; and $N>376$, then $D\leq 5$.

In the embodiment shown in FIG. 11J, the total number of dimples on the outer surface of the ball is 300, and the number of different dimple diameters is 4. In FIGS. 11H and 11I, the label numbers within the dimples designate same diameter dimples. For example, all dimples labelled 1 have the same diameter, all dimples labelled 2 have the same diameter, and so on. In a particular aspect of the embodiment illustrated in FIGS. 11H and 11I, the dimples labelled 1 have a diameter of about 0.170 inches, the dimples labelled 2 have a diameter of about 0.180 inches, the dimples labelled 3 have a diameter of about 0.150 inches, and the dimples labelled 4 have a diameter of about 0.190 inches.

In another particular aspect of the embodiments disclosed herein wherein there are two or more different dimple diameters on the outer surface of the ball, the number of different dimple diameters, D, on the outer surface is related to the total number of dimples, N, on the outer surface, such that if:

$N<320$, then $D\leq 4$;

$320\leq N<350$, then $D\leq 6$;

$350\leq N<360$, then $D\leq 4$; and $N\geq 360$, then $D\leq 7$.

In another particular aspect of the embodiments disclosed herein wherein there are two or more different dimple diameters on the outer surface of the ball, the number of different dimple diameters, D, on the outer surface is related to the total number of dimples, N, on the outer surface, such that if:

$N<328$, then $D>5$;

$N=328$, then $D>7$;

$328<N<376$, then $D>5$;

$N=376$, then $D>8$; and $N>376$, then $D>5$.

In another particular aspect of the embodiments disclosed herein wherein there are two or more different dimple diameters on the outer surface of the ball, the number of different dimple diameters, D, on the outer surface is related to the total number of dimples, N, on the outer surface, such that if:

$N<320$, then $D\geq 6$;

$320\leq N<350$, then $D\geq 7$;

$350\leq N<360$, then $D\geq 6$; and $N\geq 360$, then $D\geq 9$.

In a further particular aspect of the above embodiments wherein there are two or more different dimple diameters on the outer surface of the ball, the total number of dimples on the outer surface is less than 320, the number of different dimple diameters is less than or equal to 4, and the sample standard deviation is less than 0.0175. In another further particular aspect of the above embodiments wherein there are two or more different dimple diameters on the outer surface of the ball, the total number of dimples on the outer surface is greater than or equal to 320 but less than 350, the number of different dimple diameters is less than or equal to 6, and the sample standard deviation is less than 0.0200. In another further particular aspect of the above embodiments wherein there are two or more different dimple diameters on the outer surface of the ball, the total number of dimples on the outer surface is greater than or equal to 350 but less than 360, the number of different dimple diameters is less than or equal to 4, and the sample standard deviation is less than 0.0155. In another further particular aspect of the above embodiments wherein there are two or more different dimple diameters on the outer surface of the ball, the total number of dimples on the outer surface is greater than or equal to 360, the number of different dimple diameters is less than or equal to 7, and the sample standard deviation is less than 0.0200. Sample standard deviation, s, is defined by the equation:

$$s = \frac{\sum_{i=1}^{N}(x_i - \bar{x})^2}{N-1}$$

where $x_i$ is the diameter of any given dimple on the outer surface of the ball, $\bar{x}$ is the average dimple diameter, and N is the total number of dimples on the outer surface of the ball.

It should be understood that manufacturing variances are to be taken into account when determining the number of different dimple diameters. The placement of the dimple in the overall pattern should also be taken into account. Specifically, dimples located in the same location within the multiple copies of the domain(s) that are tessellated to form the dimple pattern are assumed to be same diameter dimples, unless they have a difference in diameter of 0.005 inches or greater.

There are no limitations to the dimple shapes or profiles selected to pack the domains. Though the present invention includes substantially circular dimples in one embodiment, dimples or protrusions (brambles) having any desired characteristics and/or properties may be used. For example, in one embodiment the dimples may have a variety of shapes and sizes including different depths and perimeters. In particular, the dimples may be concave hemispheres, or they may be triangular, square, hexagonal, catenary, polygonal or any other shape known to those skilled in the art. They may also have straight, curved, or sloped edges or sides. To summarize, any type of dimple or protrusion (bramble) known to those skilled in the art may be used with the present invention. The dimples may all fit within each domain, as seen in FIGS. 1A, 1D, 11E-11P, 11R-11X, 14A-14C, 15A-15C, 16A-16C, 17A-17C, 18A-18C, and 19A-19C, or dimples may be shared between one or more domains, as seen in FIGS. 3C-3D, so long as the dimple arrangement on each independent domain remains consistent across all copies of that domain on the surface of a particular golf ball. Alternatively, the tessellation can create a pattern that covers more than about 60%, preferably more than about 70% and preferably more than about 80% of the golf ball surface without using dimples.

In other embodiments, the domains may not be packed with dimples, and the borders of the irregular domains may instead comprise ridges or channels. In golf balls having this type of irregular domain, the one or more domains or sets of domains preferably overlap to increase surface coverage of the channels. Alternatively, the borders of the irregular domains may comprise ridges or channels and the domains are packed with dimples.

When the domain(s) is patterned onto the surface of a golf ball, the arrangement of the domains dictated by their shape and the underlying polyhedron ensures that the resulting golf ball has a high order of symmetry, equaling or exceeding 12. The order of symmetry of a golf ball produced using the method of the current invention will depend on the regular or non-regular polygon on which the irregular domain is based. The order and type of symmetry for golf balls produced based on the five regular polyhedra are listed below in Table 12.

TABLE 12

Symmetry of Golf Ball of the Present Invention as a Function of Polyhedron

| Type of Polyhedron | Type of Symmetry | Symmetrical Order |
|---|---|---|
| Tetrahedron | Chiral Tetrahedral Symmetry | 12 |
| Cube | Chiral Octahedral Symmetry | 24 |
| Octahedron | Chiral Octahedral Symmetry | 24 |
| Dodecahedron | Chiral Icosahedral Symmetry | 60 |
| Icosahedron | Chiral Icosahedral Symmetry | 60 |

These high orders of symmetry have several benefits, including more even dimple distribution, the potential for higher packing efficiency, and improved means to mask the ball parting line. Further, dimple patterns generated in this manner may have improved flight stability and symmetry as a result of the higher degrees of symmetry.

In other embodiments, the irregular domains do not completely cover the surface of the ball, and there are open spaces between domains that may or may not be filled with dimples. This allows dissymmetry to be incorporated into the ball.

Dimple patterns of the present invention are particularly suitable for packing dimples on seamless golf balls. Seamless golf balls and methods of producing such are further disclosed, for example, in U.S. Pat. Nos. 6,849,007 and 7,422,529, the entire disclosures of which are hereby incorporated herein by reference.

In a particular aspect of the embodiments disclosed herein, golf balls of the present invention have a total number of dimples, N, on the outer surface thereof, wherein N is an integer that is divisible by 4 and within a range of from 260 to 424. In a further particular aspect, golf balls of the present invention have a total number of dimples, N, on the outer surface thereof, of 260 or 280 or 300 or 304 or 308 or 312 or 328 or 344 or 348 or 352 or 376 or 388. Alternatively, the present invention provides for a low dimple count embodiment wherein golf balls of the present invention have a total number of dimples, N, on the outer surface thereof, wherein N is an integer that is divisible by 4 and less than 160.

Aerodynamic characteristics of golf balls of the present invention can be described by aerodynamic coefficient magnitude and aerodynamic force angle. Based on a dimple pattern generated according to the present invention, in one embodiment, the golf ball achieves an aerodynamic coefficient magnitude of from 0.25 to 0.32 and an aerodynamic force angle of from 30° to 38° at a Reynolds Number of 230000 and a spin ratio of 0.085. Based on a dimple pattern generated according to the present invention, in another embodiment, the golf ball achieves an aerodynamic coefficient magnitude of from 0.26 to 0.33 and an aerodynamic force angle of from 32° to 40° at a Reynolds Number of 180000 and a spin ratio of 0.101. Based on a dimple pattern generated according to the present invention, in another embodiment, the golf ball achieves an aerodynamic coefficient magnitude of from 0.27 to 0.37 and an aerodynamic force angle of from 35° to 44° at a Reynolds Number of 133000 and a spin ratio of 0.133. Based on a dimple pattern generated according to the present invention, in another embodiment, the golf ball achieves an aerodynamic coefficient magnitude of from 0.32 to 0.45 and an aerodynamic force angle of from 39° to 45° at a Reynolds Number of 89000 and a spin ratio of 0.183. For purposes of the present disclosure, aerodynamic coefficient magnitude ($C_{mag}$) is defined by $C_{mag}=(C_L^2+C_D^2)^{1/2}$ and aerodynamic force angle ($C_{angle}$) is defined by $C_{angle}=\tan^{-1}(C_L/C_D)$, where $C_L$ is a lift coefficient and $C_D$ is a drag coefficient. Aerodynamic characteristics of a golf ball, including aerodynamic coefficient magnitude and aerodynamic force angle, are disclosed, for example, in U.S. Pat. No. 6,729,976 to Bissonnette et al., the entire disclosure of which is hereby incorporated herein by reference. Aerodynamic coefficient magnitude and aerodynamic force angle values are calculated using the average lift and drag values obtained when 30 balls are tested in a random orientation. Reynolds number is an average value for the test and can vary by plus or minus 3%. Spin ratio is an average value for the test and can vary by plus or minus 5%.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having an outer surface comprising a plurality of dimples disposed thereon, wherein the dimples are arranged in multiple copies of a first domain and a second domain, the first domain and the second domain being tessellated to cover the outer surface of the golf ball in a uniform pattern having no great circles and consisting of four first domains and four second domains, and wherein:

the dimple pattern within the first domain is different from the dimple pattern within the second domain;

the plurality of dimples comprises dimples having four or more different diameters including a minimum dimple diameter, a maximum dimple diameter, and at least two additional dimple diameters;

the first domain is defined by three irregular segments and has three-way rotational symmetry about the central point of the first domain;

the second domain is defined by three irregular segments and has three-way rotational symmetry about the central point of the second domain;

the first domain consists of perimeter dimples and interior dimples, wherein the perimeter dimples of the first domain are those dimples located within the first domain that are positioned adjacent to the three irregular segments defining the first domain and the interior dimples of the first domain are those dimples located within the first domain that are not positioned adjacent to the three irregular segments defining the first domain;

the second domain consists of perimeter dimples and interior dimples, wherein the perimeter dimples of the second domain are those dimples located within the second domain that are positioned adjacent to the three irregular segments defining the second domain and the interior dimples of the second domain are those dimples located within the second domain that are not positioned adjacent to the three irregular segments defining the second domain;

the perimeter dimples of the first domain include from one to ten dimples having the maximum dimple diameter; and the perimeter dimples of the second domain include from one to ten dimples having the maximum dimple diameter.

2. The golf ball of claim 1, wherein the number of dimples located in the first domain and having the maximum dimple diameter is equal to the number of dimples located in the second domain and having the maximum dimple diameter.

3. The golf ball of claim 1, wherein the perimeter dimples of the first domain include at least one dimple having the minimum dimple diameter.

4. The golf ball of claim 1, wherein the interior dimples of the second domain include at least one dimple having the minimum dimple diameter.

5. The golf ball of claim 1, wherein the number of dimples located in the first domain and having the minimum dimple diameter is equal to the number of dimples located in the second domain and having the minimum dimple diameter.

6. The golf ball of claim 5, wherein the number of dimples located in the first domain and having the minimum dimple diameter is three or greater.

7. The golf ball of claim 1, wherein the number of dimples located in the first domain and having the minimum dimple diameter is three or greater.

8. The golf ball of claim 1, wherein the interior dimples of the first domain do not include a dimple having the maximum dimple diameter.

9. The golf ball of claim 1, wherein the interior dimples of the second domain include at least one dimple having the maximum dimple diameter.

10. A golf ball having an outer surface comprising a plurality of dimples disposed thereon, wherein the dimples are arranged in multiple copies of a first domain and a second domain, the first domain and the second domain being tessellated to cover the outer surface of the golf ball in a uniform pattern having no great circles and consisting of four first domains and four second domains, and wherein:

the dimple pattern within the first domain is different from the dimple pattern within the second domain;

the plurality of dimples comprises dimples having five or more different diameters including a minimum dimple diameter, a maximum dimple diameter, and at least three additional dimple diameters;

the first domain is defined by three irregular segments and has three-way rotational symmetry about the central point of the first domain;

the second domain is defined by three irregular segments and has three-way rotational symmetry about the central point of the second domain;

the first domain consists of perimeter dimples and interior dimples, wherein the perimeter dimples of the first domain are those dimples located within the first domain that are positioned adjacent to the three irregular segments defining the first domain and the interior dimples of the first domain are those dimples located within the first domain that are not positioned adjacent to the three irregular segments defining the first domain;

the second domain consists of perimeter dimples and interior dimples, wherein the perimeter dimples of the second domain are those dimples located within the second domain that are positioned adjacent to the three irregular segments defining the second domain and the interior dimples of the second domain are those dimples located within the second domain that are not positioned adjacent to the three irregular segments defining the second domain;

the perimeter dimples of the first domain include at least one dimple having the minimum dimple diameter;

the interior dimples of the first domain include at least one dimple having the minimum dimple diameter; and the number of interior dimples of the first domain having the minimum dimple diameter is at least two times the number of perimeter dimples of the first domain having the minimum dimple diameter.

11. The golf ball of claim 10, wherein the number of perimeter dimples located in the first domain and having the minimum dimple diameter is three or greater.

12. The golf ball of claim 10, wherein the first domain includes at least one dimple having the maximum dimple diameter.

13. The golf ball of claim 10, wherein the interior dimples of the first domain include at least one dimple having the maximum dimple diameter.

14. The golf ball of claim 10, wherein the second domain includes at least one dimple having the maximum dimple diameter.

15. The golf ball of claim 10, wherein the perimeter dimples of the second domain include at least one dimple having the maximum dimple diameter.

16. The golf ball of claim 10, wherein the second domain includes at least one dimple having the minimum dimple diameter.

17. The golf ball of claim 10, wherein the interior dimples of the second domain include at least one dimple having the minimum dimple diameter.

18. The golf ball of claim 10, wherein the number of dimples located in the first domain and having the maximum dimple diameter is equal to the number of dimples located in the second domain and having the maximum dimple diameter.

* * * * *